US009888761B2

(12) United States Patent
Kao

(10) Patent No.: US 9,888,761 B2
(45) **Date of Patent: *Feb. 13, 2018**

(54) BACKPACK WITH SUSPENSION ARRANGEMENT

(71) Applicant: Peter Kao, Union City, CA (US)

(72) Inventor: Peter Kao, Union City, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/232,772

(22) Filed: Aug. 9, 2016

(65) Prior Publication Data

US 2017/0265630 A1 Sep. 21, 2017

Related U.S. Application Data

(63) Continuation-in-part of application No. 15/076,622, filed on Mar. 21, 2016.

(51) Int. Cl.
*A45F 3/04* (2006.01)

(52) U.S. Cl.
CPC ..... *A45F 3/047* (2013.01)

(58) Field of Classification Search
CPC .... A45F 3/047; A45F 3/04; A45F 3/12; A45F 3/14; A45C 13/30
See application file for complete search history.

(56) References Cited

U.S. PATENT DOCUMENTS 4,976,388 A * 12/1990 Coontz ..... A45C 13/30 224/150
5,411,194 A * 5/1995 Nagasawa ..... A45C 13/26 224/254
5,615,811 A * 4/1997 Bell ..... F41C 23/02 224/150
6,375,053 B1 * 4/2002 Cecchinel ..... A45C 13/30 224/264
6,802,442 B1 * 10/2004 Thompson ..... A44B 11/14 224/259
7,100,809 B2 * 9/2006 Arnold ..... A45F 3/08 224/604
8,366,081 B2 * 2/2013 Staihar ..... A45C 13/001 267/69
9,192,221 B2 * 11/2015 Just ..... A45C 13/02
9,585,462 B2 * 3/2017 Engdahl ..... A45F 3/04

* cited by examiner

*Primary Examiner* — Corey Skurdal

(74) *Attorney, Agent, or Firm* — Raymond Y. Chan; David and Raymond Patent Firm

(57) ABSTRACT

A backpack includes a pack body, two shoulder straps extended from the pack body for allowing the wearer to wear the pack body at the wearer's back, and a suspension arrangement which includes a resilient unit provided between the pack body and the shoulder straps for absorbing a bounding force of the pack body. Therefore, the resilient unit allows a relative movement of the pack body with respect to each of the shoulder straps but minimizes the relative movement of the pack body by absorbing the bounding force of the pack body. The resilient unit is also arranged for evenly distributing a loading force of the pack body to each of the shoulder straps, such that the resilient unit absorbs the bounding force of the pack body at different directions so as to balance the uneven loading force at the pack body.

20 Claims, 22 Drawing Sheets

| | Normal Backpack(unit: PSI) | Present Backpack (unit: PSI) |
|---|---|---|
| 3 mph - Max Pressure | 75 | 72 |
| 4 mph - Max Pressure | 85 | 80 |
| 5 mph - Max Pressure | 99 | 85 |
| 6 mph - Max Pressure | 105 | 93 |
| 7 mph - Max Pressure | 110 | 96 |
| 8 mph - Max Pressure | 129 | 100 |

PSI: pound per square inch mph: mile per hour

FIG. 21

BACKPACK WITH SUSPENSION ARRANGEMENT

CROSS REFERENCE OF RELATED APPLICATION

This is a Continuation-In-Part application that claims priority to U.S. non-provisional application, application Ser. No. 15/076,622, filed Mar. 21, 2016, the entire contents of each of which are expressly incorporated herein by reference.

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a backpack, and more particularly to a backpack with a suspension arrangement, which suspends the load at the backpack to minimize a continuous bounding movement/force of the backpack to the wearer's body when the wearers walks or runs.

Description of Related Arts

Backpacks generally comprises a bag body and two shoulder straps extended from the bag body, wherein the backpacks rely on the shoulder straps to carry the load at the bag body, the load exerts a backward pulling force at the shoulders of the wearer, causing back fatigue and strain. Especially, students, i.e. the wearers, often carry heavy books to and from school. Therefore, musculoskeletal experts are warning the parents that a young child often has an epidemic of back problems due to the continuous use of heavy backpack. According to the American Occupational Therapy Association, a student backpack should not weight more than 15 percent of the wearer's weight. When the wearer stands still, the loading force at the bag body is a static force equal to the weight of the load. However, when the wearer walks or runs, the loading force at the bag body is larger than the weight of the load. In particular, the loading force will change at all times during the body movement of the wearer. It is because the bag body will move up and down during the body movement of the wearer, wherein a gravity force is added into the weight of the load. In other words, the rapid or vigorous body movement of the wearer will dramatically increase the loading force at the bag body. For the wearers who need to carry heavy load, such as students, campers, hikers, or golfers, the loading force may not be evenly transferred to the shoulder straps. In other words, the center of mass of the wearer will shift during the body movement of the wearer, causing the wearer to trip or fail.

An improved backpack incorporates with a suspended loading device to minimize the up and down movement of the bag body. Accordingly, the suspended loading device comprises a suspension frame, wherein the shoulder straps are coupled at one side of the suspension frame and the bag body is movably coupled at another side of the suspension frame. Due to the relative movement between the bag body and the suspension frame, the up and down movement of the bag body can be minimized to transfer to the shoulder straps. However, such suspended loading device has several drawbacks. Accordingly, the suspension frame is relatively heavy added onto the weight of the bag body. Therefore, the overall weight of the backpack, including the load at the bag body and weight of the suspension frame, will directly exert to the wearer's body through the shoulder straps. In addition, more than one item is disposed in the bag body, which causes the uneven distribution of the weight of the bag body. However, the suspended loading device can only minimize the up and down movement of the bag body but cannot evenly distribute the loading force to the shoulder straps. As a result, the wearer's body will lean toward one side where the heavier load is exerted at one of the shoulder straps.

The conventional backpack further has a drawback that the bag body only has the top opening to communicate with the bag cavity in the bag body, wherein the top opening is defined at a top rim of the bag body. In particular, the bag body has an elongated shape that a length of the bag body is larger than a width thereof. As a result, the wearer will put or take the items in the bag cavity of the bag body through the top opening thereof. As a result, the wearer is unable to take the items at the bottom of the bag cavity through the top opening because the items at the bottom of the bag cavity are covered by and hidden under the items at the top of the bag cavity. In other words, the wearer must take out the items at the top of the bag cavity in order to access the bottom thereof. Furthermore, the wearer would like to carry a portable electronic device, such as laptop or tablet computer, by the backpack that the portable electronic device and different items are mixed and stored in the bag cavity. Even though the portable electronic device can be protected from any external force at the bag body, the portable electronic device is collided with the items within the bag body. It is worth mentioning that when the portable electronic device is taken out of the bag cavity, it is always a hard time for the wearer to put back the portable electronic device into the bag cavity at its original position.

SUMMARY OF THE PRESENT INVENTION

The invention is advantageous in that it provides a backpack with a suspension arrangement, which suspends the load at the backpack to minimize a continuous bounding movement/force of the backpack to the wearer's body when the wearers walks or runs.

Another advantage of the invention is to a backpack with a suspension arrangement, which comprises a resilient unit provided between a pack body and two shoulder straps for absorbing a bounding force of the pack body. Therefore, the resilient unit allows a relative movement of the pack body with respect to each of the shoulder straps but minimizes the relative movement of the pack body by absorbing the bounding force of the pack body.

Another advantage of the invention is to a backpack with a suspension arrangement, wherein the resilient unit is adapted for evenly distributing a loading force of the pack body to each of the shoulder straps, such that the resilient unit can absorb the bounding force of the pack body at different directions, such as an up-and-down direction or a lateral direction.

Another advantage of the invention is to a backpack with a suspension arrangement, wherein the suspension arrangement not only minimizes any up-and-down movement of the backpack but also reduces any sideward swinging movement of the backpack.

Another advantage of the invention is to a backpack with a suspension arrangement, wherein a tension of the resilient unit is adjustable to incorporate with the backpack depending on the load thereat. Therefore, the wearer is able to increase the tension of the resilient unit for carrying a heavier load at the backpack or decrease the tension of the resilient unit for carrying a lighter load at the backpack.

Another advantage of the invention is to a backpack with a suspension arrangement, wherein the pack body has an accessing arrangement for enlarging an opening area of the pack body, such that the wearer is able to easily access the bottom of the storage cavity via the enlarged opening area.

Another object of the present invention is to provide a backpack with a suspension arrangement, which does not require to alter the original structural design of the backpack, so as to minimize the manufacturing cost of the backpack incorporating with the suspension arrangement.

Another object of the present invention is to provide a backpack with a suspension arrangement, wherein no expensive or complicated structure is required to employ in the present invention in order to achieve the above mentioned objects. Therefore, the present invention successfully provides an economic and efficient solution for minimizing any continuous bounding movement/force of the backpack to the wearer's body when the wearers walks or runs so as to prevent the cause of the back fatigue and strain for the wearer.

Additional advantages and features of the invention will become apparent from the description which follows, and may be realized by means of the instrumentalities and combinations particular point out in the appended claims.

According to the present invention, the foregoing and other objects and advantages are attained by a backpack, comprising:

a pack body configured for being disposed on a wearer's back;

a carrying system which comprises two length-adjustable shoulder straps extended from the pack body for allowing the wearer to wear the pack body at the wearer's back; and a suspension arrangement which comprises a resilient unit provided between the pack body and the shoulder straps for absorbing a bounding force of the pack body and for evenly distributing a loading force of the pack body to each of the shoulder straps so as to minimize a relative movement of the pack body with respect to each of the shoulder straps.

Still further objects and advantages will become apparent from a consideration of the ensuing description and drawings.

These and other objectives, features, and advantages of the present invention will become apparent from the following detailed description, the accompanying drawings, and the appended claims.

BRIEF DESCRIPTION OF THE DRAWINGS

FIG. 21 is a table illustrating the maximum pressure applied to the shoulders of the wearer with respect to the acceleration thereof for the present backpack and the normal backpack.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
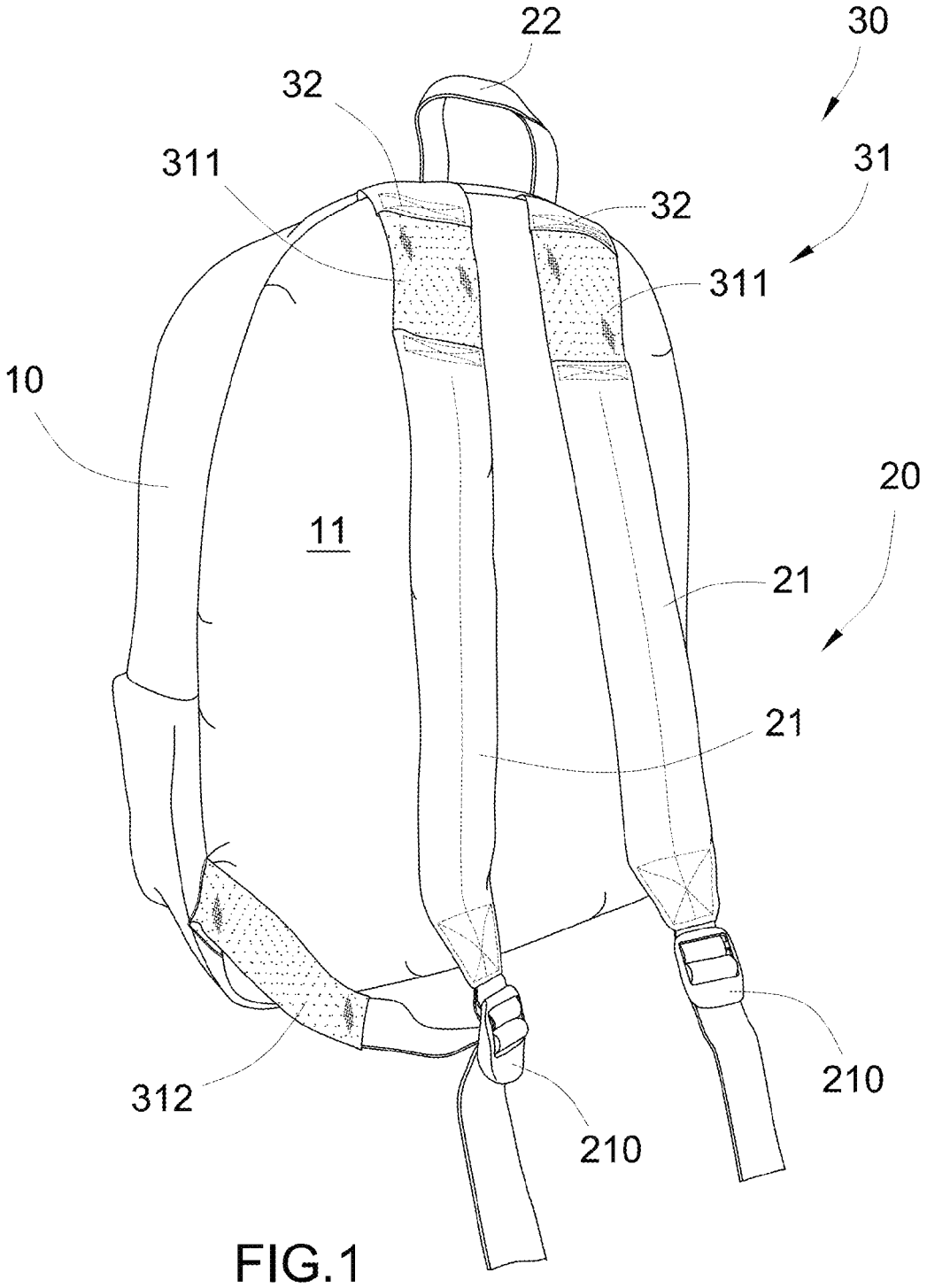
FIG. 1 is a rear perspective view of a backpack with a suspension arrangement according to a preferred embodiment of the present invention.
Figure 2:
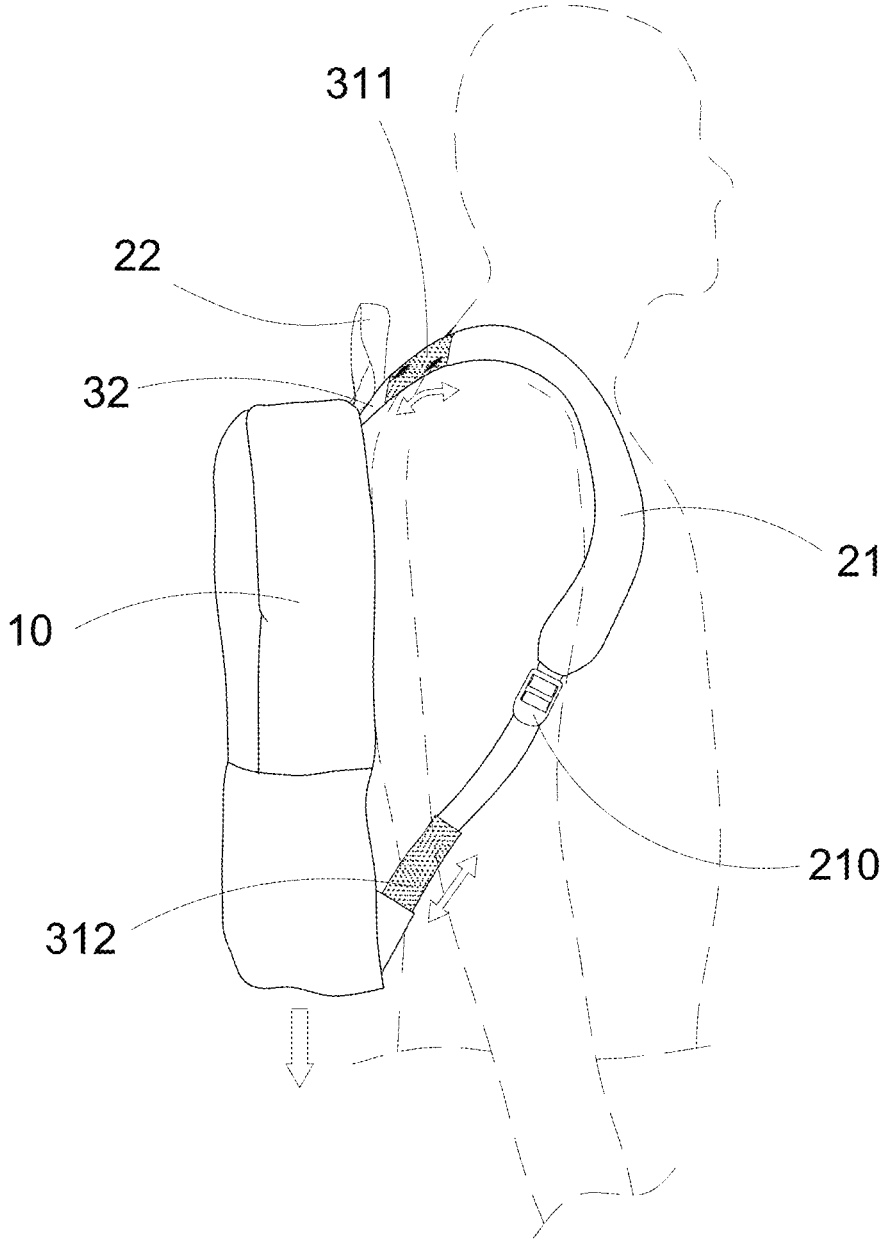
FIG. 2 is a side view of the backpack with the suspension arrangement worn by a wearer according to the above preferred embodiment of the present invention.

Referring to FIGS. 1 and 2 of the drawings, a backpack according to a preferred embodiment of the present invention is illustrated, wherein the backpack, which is an ergonomic backpack, comprises a pack body 10, a carrying system 20, and a suspension arrangement 30.

The pack body 10 is configured for being disposed on a wearer's back, wherein the pack body 10 has a storage cavity for receiving one or more items as a load of the pack body 10, wherein the pack body 10 has a back side 11.

The carrying system 20 comprises two length-adjustable shoulder straps 21 extended from the pack body 10 for allowing the wearer to wear the pack body 10 at the wearer's back. Preferably, the shoulder straps 21 are provided at the back side 11 of the pack body 10. The carrying system 20 further comprises a handle loop 22 provided on a top side of the pack body 10. Each of the shoulder straps 21 has a strap slide 210 to selectively adjust a length of the shoulder strap 21. It is worth mentioning that the strap slide 210 can also allow the lower end of the shoulder strap 21 to be detached from the pack body 10.

The suspension arrangement 30 comprises a resilient unit 31 provided between the pack body 10 and the shoulder straps 21, wherein the resilient unit 31 allows a relative movement of the pack body 10 with respect to each of the shoulder straps 21. Accordingly, the conventional backpack is constructed that the shoulder straps are affixed to the bag body, such that conventional backpack does not provide any means for allowing the relative movement of the bag body with respect to the shoulder straps. As a result, the loading force is directly exerted to the shoulder straps from the bag body. In view of the present invention, the resilient unit 31 provides a predetermined tension between the pack body 10 and the shoulder straps 21, such that the pack body 10 can be relatively moved with respect to the shoulder straps 21.

In particular, the resilient unit 31 of the present invention generates a predetermined resilient force between the pack body 10 and the shoulder straps 21 for absorbing a bounding force of the pack body 10, especially when the wearers walks or runs, to minimize the relative movement of the pack body 10 with respect to each of the shoulder straps 21. As it is mentioned above, if there is no relative movement of the pack body 10 with respect to the shoulder straps 21, the loading force is directly exerted to the shoulder straps 21 from the pack body 10. On the other hand, when there is a relative large movement of the pack body 10 with respect to the shoulder straps 21, the bounding force of the pack body 10 will be varied in response to the movement of the pack body 10, causing the backpack to be worn uncomfortably. Therefore, the resilient unit 31 of the present invention allows the relative movement of the pack body 10 with respect to each of the shoulder straps 21 but minimizes the relative movement of the pack body 10 by absorbing the bounding force of the pack body 10.

The resilient unit 31 is also provided at the shoulder straps 21 individually for evenly distributing the loading force of the pack body 10 to each of the shoulder straps 21, such that the resilient unit 31 can absorb the bounding force of the pack body 10 at different directions, such as an up-and-down direction or a lateral direction. For example, when the items are unevenly disposed in the pack body 10, the loading force may not be exerted at a centerline of the pack body 10. As a result, the loading force may be evenly distributed to the shoulder straps 21. Since the resilient unit 31 of the present invention is provided at the shoulder straps 21 individually, the resilient unit 31 will generate the independent resilient force at each of the shoulder straps 21 to balance the uneven loading force at the pack body 10, such that the loading force can be evenly distributed the loading force of the pack body 10 to each of the shoulder straps 21.

As shown in FIG. 1, the resilient unit 31 comprises two resilient straps 311 extended from upper ends of the shoulder straps 21 respectively to the pack body 10, wherein each of the resilient straps 311 provides the resilient force to absorb the bounding force of the pack body 10 to the respective shoulder strap 21. In other words, the two resilient straps 311 provide the independent resilient forces at the shoulder straps 21 respectively to individually absorb the bounding force of the pack body 10.

The resilient unit 31 further comprises two lower resilient straps 312 extended from lower ends of the shoulder straps 21 respectively to the pack body 10, wherein the lower resilient straps 312 will also provide the resilient force to absorb the bounding force of the pack body 10 to the respective shoulder strap 21. The resilient straps 311, 312 are made of stretchable material to generate the resilient force. Preferably, the resilient straps 311 are permanently affixed between the upper ends of the shoulder straps 21 and the pack body 10, and the lower resilient straps 312 are permanently affixed between the lower ends of the shoulder straps 21 and the pack body 10. It is worth mentioning that the strap slide 210 can also allow the lower end of the shoulder strap 21 to be detached from the lower resilient straps 312 so as to detach the lower end of the shoulder strap 21 from the pack body 10.

Accordingly, the two resilient straps 311 at the upper ends of the shoulder straps 21 serve as two upper resilient straps 311, such that each of the shoulder straps 21 is coupled to the pack body 10 via the upper resilient strap 311 and the lower resilient strap 312. It is worth mentioning that the lower resilient straps 312 will pull the back side 11 of the pack body 10 close to the back of the wearer when the backpack is worn to ensure the weight of the pack body 10 to close to the center of mass of the wearer. In addition, the upper and lower resilient straps 311, 312 will provide the resilient forces at different directions of the pack body 10 for not only minimizing any up-and-down movement of the backpack but also reducing any sideward swinging movement of the backpack.

Figure 3:
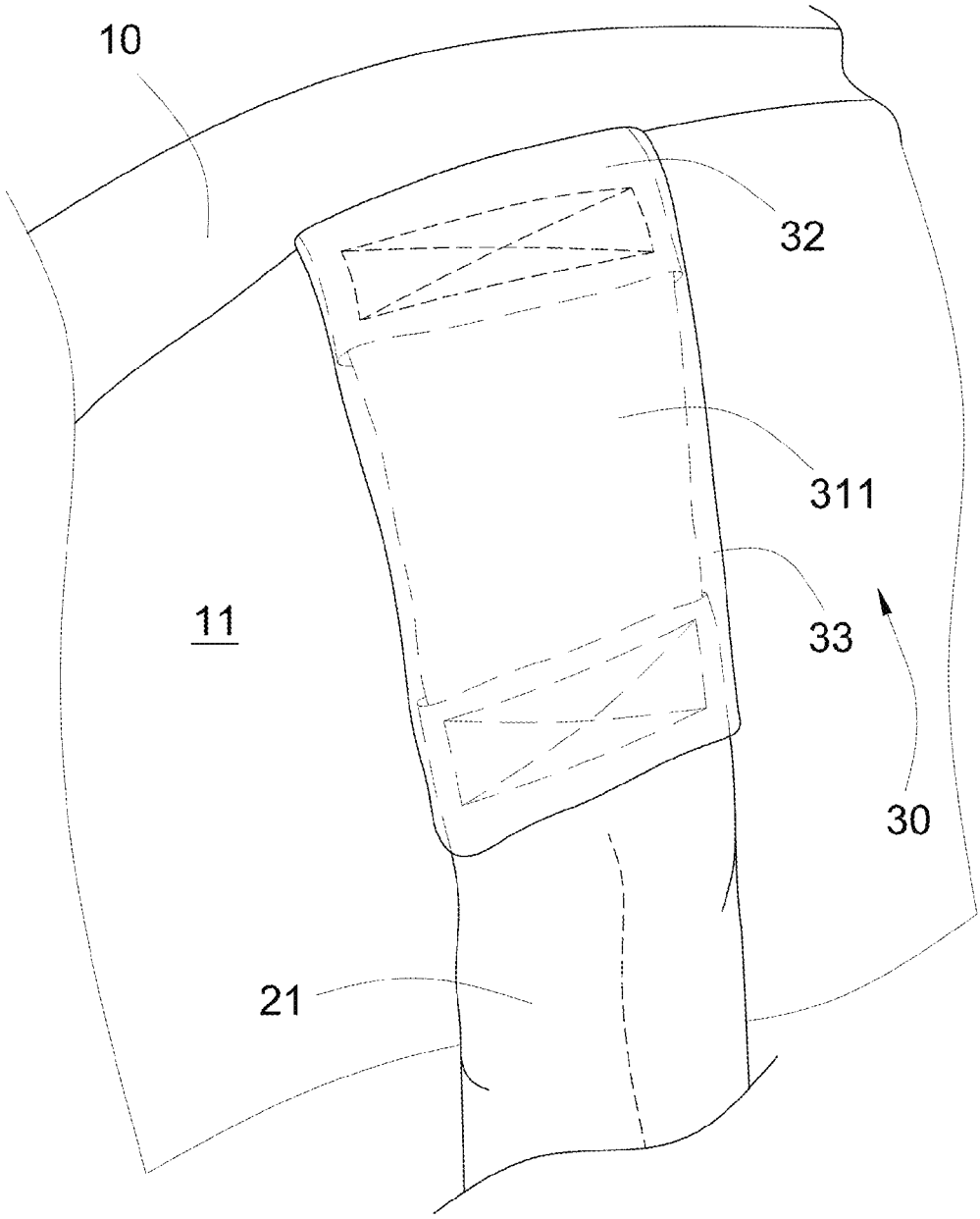
FIG. 3 is a perspective view of the suspension arrangement of the backpack according to the above preferred embodiment of the present invention.

As shown in FIG. 3, in order to secure the resilient straps 311 at the pack body 10, the suspension arrangement 30 further comprises two extension tongues 32 extended from the back side 11 of the pack body 10, wherein the resilient straps 311 are extended between the upper ends of the shoulder straps 21 and the extension tongues 32 respectively. Preferably, the extension tongues 32 are permanently and securely affixed to the back side 11 of the pack body 10 at a top edge thereof by stitching. It is worth mentioning that the two extension tongues 32 ensure the direction of force to be transferred. In particular, the two extension tongues 32 ensure the loading force at the pack body 10 to be transferred along the resilient straps 311.

As shown in FIG. 3, each of the resilient straps 311 has a rectangular shape that a width of an upper edge is the same as a width a lower edge, wherein the upper edge of the resilient strap 311 is extended from the extension tongue 32 and the lower edge of the resilient strap 311 is extended from the upper end of the shoulder strap 21. This uniform width of the resilient strap 31 will ensure the loading force to be transferred to the shoulder strap 21. In addition, the resilient force at the upper edge of the resilient strap 311 is the same as the resilient force at lower edge of the resilient strap 311 to ensure the uniform resilient force thereat to support the pack body 10. Preferably, the upper edge of the resilient strap 311 is permanently affixed to the extension tongue 32 by stitching and the lower edge of the resilient strap 311 is permanently affixed to the upper end of the shoulder strap 21 by stitching.

In addition, the suspension arrangement 30 further comprises two receiving sleeves 33 extended from the pack body to the upper ends of the shoulder straps 21 to receive the resilient straps 311 within the receiving sleeves 33 respectively in a hidden manner, as shown in FIG. 3. Each of the receiving sleeves 33 has a tubular shape to receive the resilient strap 311. Accordingly, the upper ends of the shoulder straps 21 are also received in the receiving sleeves 33 in a hidden manner. It is worth mentioning that the upper edges of the receiving sleeves 33 are affixed to secure the receiving sleeves 33 and the lower edges of the receiving sleeves 33 are non-stitched, such that the upper ends of the shoulder straps 21 can be freely slid within the receiving sleeves 33 respectively to allow the resilient straps 311 to be stretched correspondingly.

In particular, a length of each of the receiving sleeves 33 is long enough to cover the maximum length of the resilient strap 311 that the resilient strap 311 is stretched in a maximum condition between the upper edge and the lower edge. Therefore, when the backpack is worn by the wearer, the two resilient straps 311 are hidden and cannot be seen. Preferably, the two receiving sleeves 33 are extended from the extension tongues 33, preferably affix to the extension tongues 33, to the upper ends of the shoulder straps 21 to receive the resilient straps 311 within the receiving sleeves 33 respectively in a hidden manner.

Figure 4:
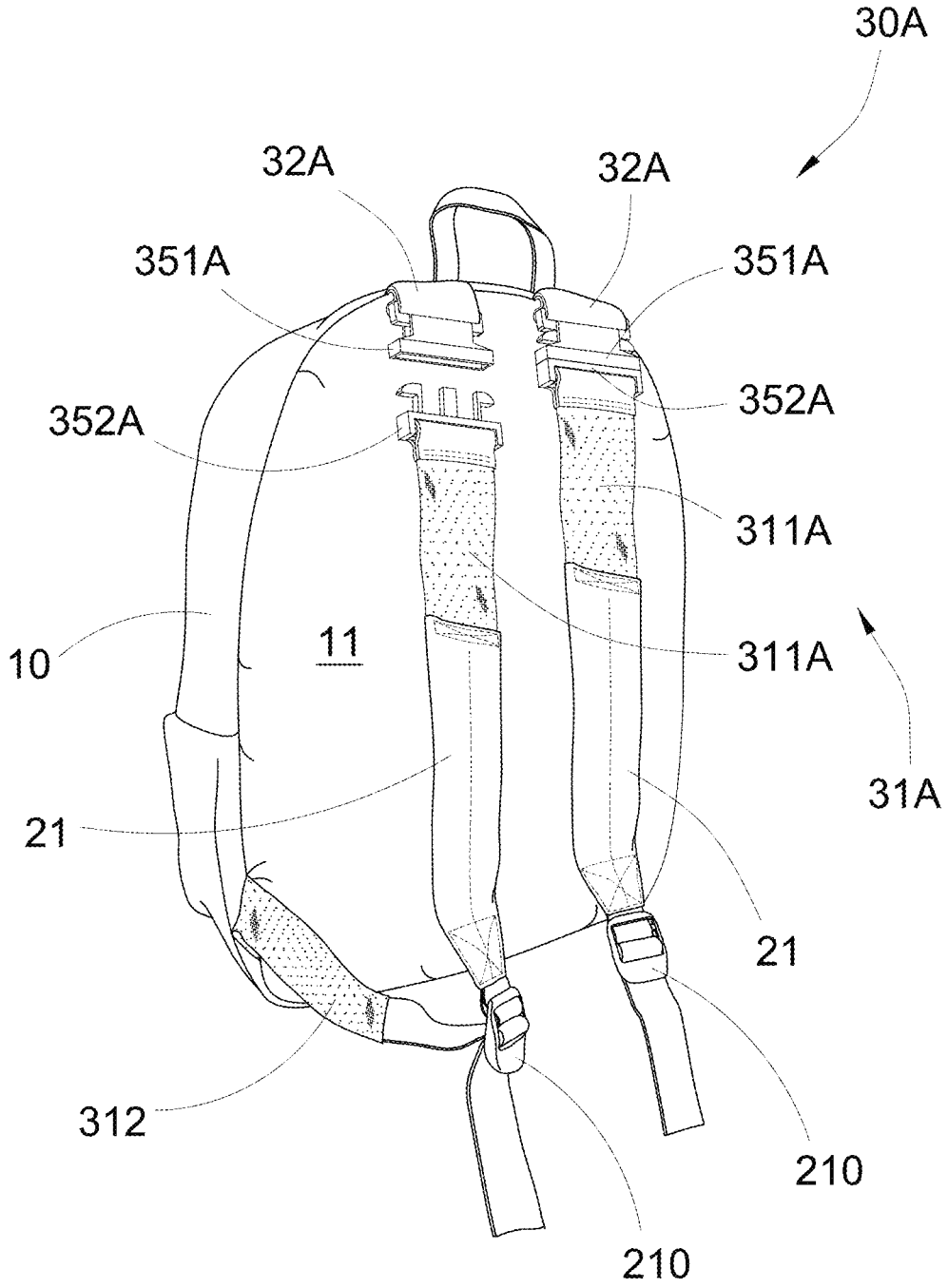
FIG. 4 illustrates a first alternative mode of the suspension arrangement of the backpack according to the above preferred embodiment of the present invention, illustrating the detachable feature of the suspension arrangement.

According to the preferred embodiment, the tension of the resilient unit 31 should be increased for carrying a heavier load at the backpack or decreased for carrying a lighter load at the backpack. FIG. 4 illustrates a first alternative mode of the suspension arrangement 30A to allow the user to adjust the tension of the resilient unit 31A. As shown in FIG. 4, the resilient straps 311A is detachably affixed to the pack body 10, such that the user is able to change different resilient straps 311A with different tensions corresponding to the load of the backpack.

Accordingly, the suspension arrangement 30A further comprises two first strap fasteners 351A extended from the back pack 10 and two second strap fasteners 352A provided at the resilient straps 311A respectively, wherein the first strap fasteners 351 are detachably coupled with the second strap fasteners 352A to detachably couple the resilient straps 311A at the pack body 10. It is worth mentioning that the upper edge of the resilient strap 311A is coupled to the second strap fastener 352A and the lower edge of the resilient strap 311A is extended from the upper end of the shoulder strap 21. Preferably, the first strap fasteners 351 are coupled at the extension tongues 32A respectively. Preferably, the first and second strap fasteners 351A, 352A are quick release buckle clip mechanism. It is appreciated the first and second strap fasteners 351A, 352A can be other fastening mechanisms such as snap hooks for detachably affixing the resilient straps 311A to the pack body 10. It is worth mentioning that the receiving sleeves 33 can be incorporated with this detachably affixing structure to cover the first and second strap fasteners 351A, 352A.

Figure 5:
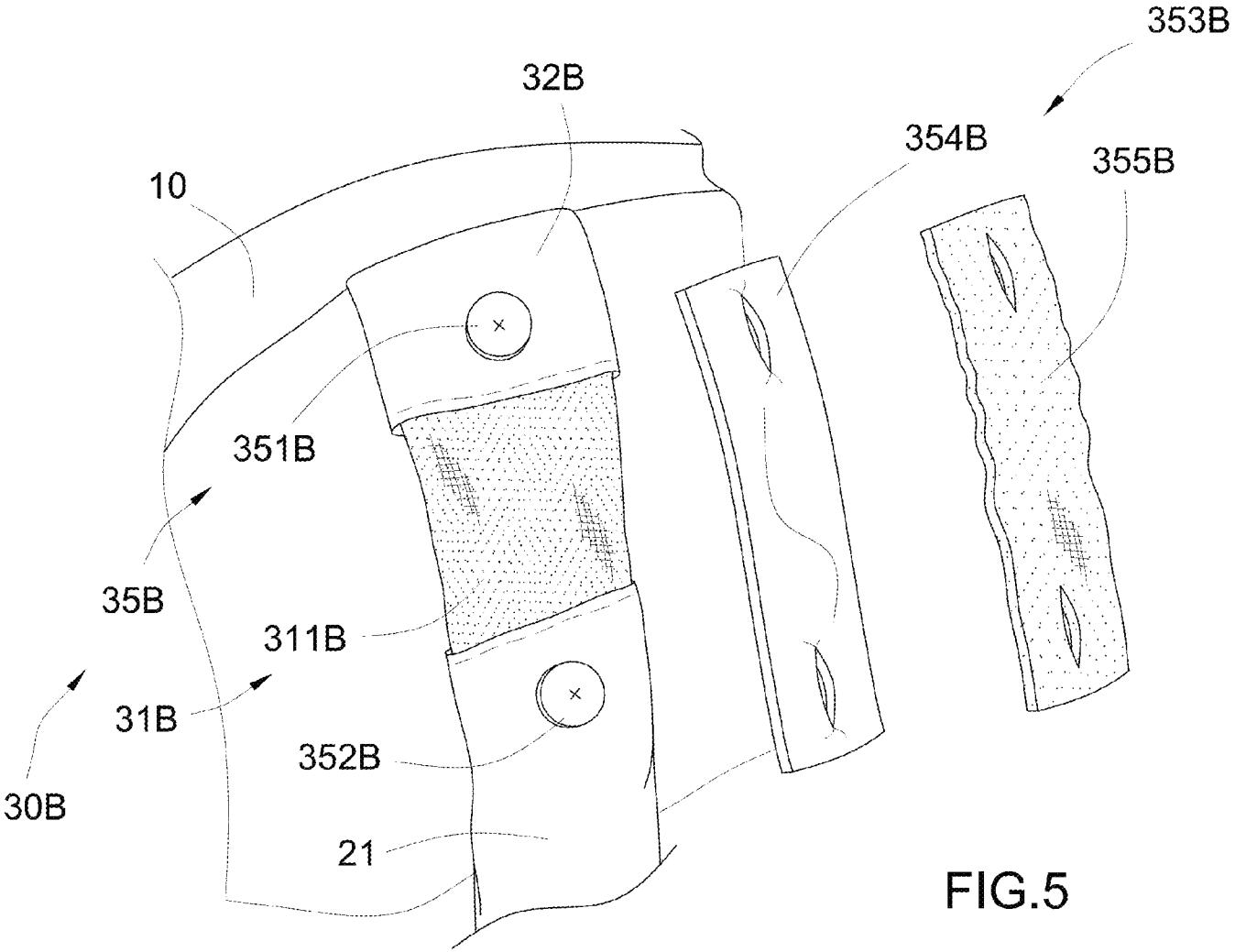
FIG. 5 illustrates a second alternative mode of the suspension arrangement of the backpack according to the above preferred embodiment of the present invention, illustrating the tension adjustment of the suspension arrangement.

FIG. 5 illustrates a second alternative mode the suspension arrangement 30B to allow the user to adjust the tension of the resilient unit 31B via a tension adjusting unit 35B. In particular, the user is able to adjust selectively adjust the tension of each of said resilient straps 311B via the tension adjusting unit 35B. As shown in FIG. 5, the tension adjusting unit 35B comprises a first adjusting fastener 351B provided at the pack body 10, a second adjusting fastener 352B provided at each of the shoulder straps 21, and a tension adjustor 353B detachably fastening the first and second adjusting fasteners 351B, 352B to selectively adjust the tension of the respective resilient strap 311B. Preferably, two first adjusting fasteners 351B are provided at the extension tongues 32B respectively and two second adjusting fastener 352B are provided at the upper ends of the shoulder straps 21 respectively. Therefore, the tension of each of said resilient straps 311B can be selectively adjusted via the tension of the tension adjustor 353B.

Accordingly, when the tension adjustor 353B is made of non-stretchable material to serve as a non-stretchable member 354B detachably fastening the first and second adjusting fasteners 351B, 352B, the distance between the pack body 10 and the upper end of the shoulder strap 21 is fixed to restrict the respective resilient strap 311B to be stretched. When the tension adjustor 353B is made of stretchable material to serve as a stretchable member 355B detachably fastening the first and second adjusting fasteners 351B, 352B, the tension adjustor 353B has a predetermined tension added on to each of the resilient straps 311B. Therefore, the overall tension of the resilient strap 311B and the tension adjustor 353B will be increased for carrying a heavier load of the pack body 10. Preferably, the first and second adjusting fasteners 351B, 352B are two buttons, wherein two button holes are formed at two end portions of the tension adjustor 353B to detachably fasten the tension adjustor 353B with the first and second adjusting fasteners 351B, 352B. It is appreciated that different fasteners can be used for detachably fastening the tension adjustor 353B between the pack body 10 and the shoulder strap 21. Therefore, depending the load of the pack body 10, the user is able to change different tension adjustors 353B to adjust selectively adjust the tension of each of said resilient straps 311B.

Figure 6:
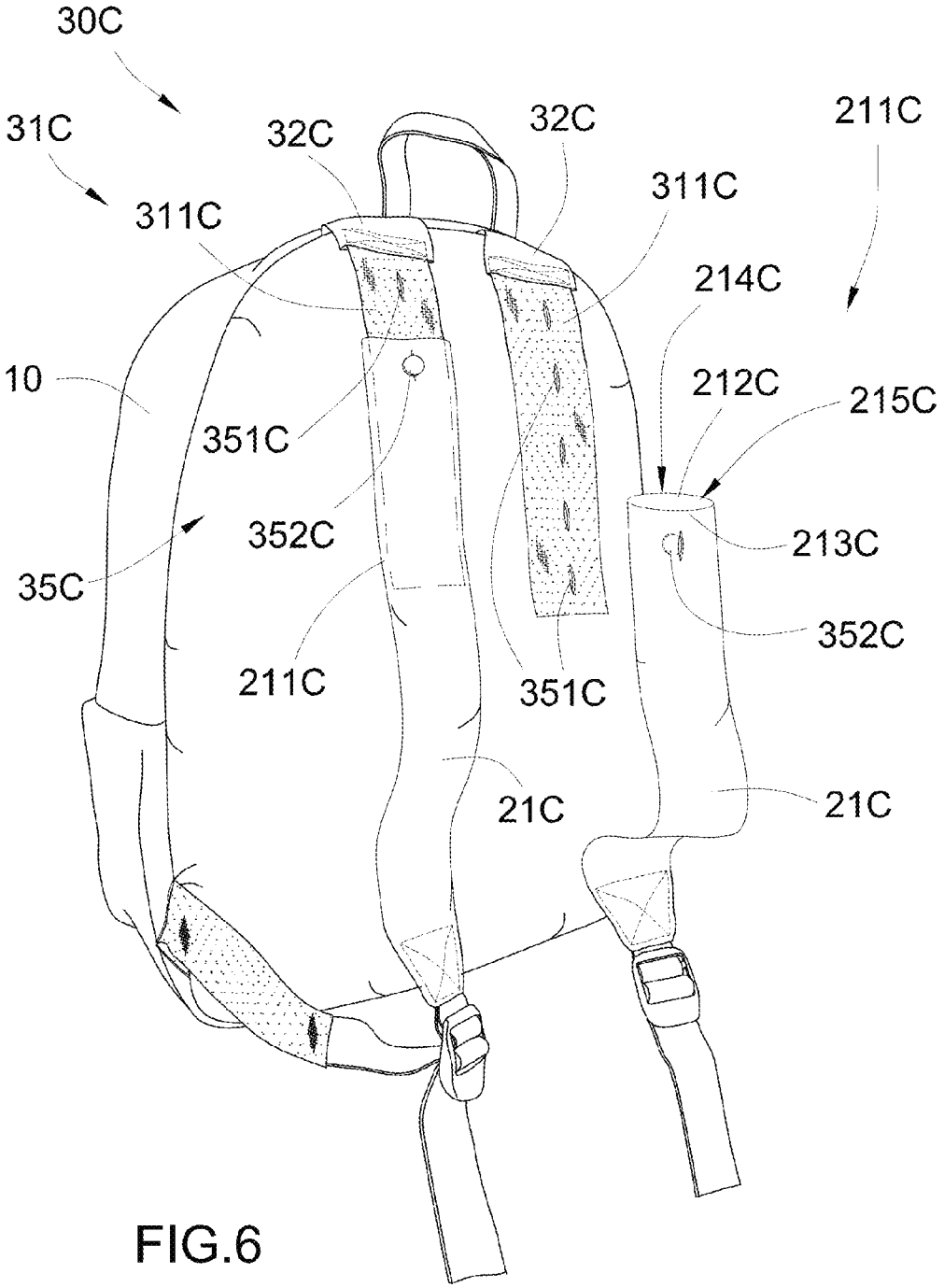
FIG. 6 illustrates a third alternative mode of the suspension arrangement of the backpack according to the above preferred embodiment of the present invention, illustrating the alternative tension adjustment of the suspension arrangement.

FIG. 6 illustrates a third alternative mode the suspension arrangement 30C to allow the user to adjust the tension of the resilient unit 31C via a tension adjusting unit 35C. As shown in FIG. 6, each of the shoulder straps 21C comprises a cushioning sleeve 211C defining an inner cushioning layer 212C and an outer cushioning layer 213C overlapped thereon, wherein a sliding cavity 214C is formed between said inner and outer cushioning layers 212C, 213C and a top opening 215C formed at the upper end of the shoulder straps 21C to communicate with the sliding cavity 214C.

Each of the resilient straps 311C is extended from the pack body 10 to slidably receive in the cushioning sleeve 211C. In particular, each of the resilient straps 311C is securely extended from the extension tongues 32C at the pack body 10 to slidably receive within the sliding cavity 214C through the top opening 215C.

The tension adjusting unit 35C comprises a plurality of first tension fasteners 351C spacedly formed at each of the resilient straps 311C and a second tension fastener 352C formed at the cushioning sleeve 211C to selectively fasten with one of the first tension fasteners 351C so as to selectively adjust the tension of the resilient strap 311C. Accordingly, the first tension fasteners 351C are embodied as a plurality of first button holes spacedly formed along the resilient straps 311C. The second tension fastener 352C comprises a fastening button provided at the cushioning sleeve 211C to selectively fasten with one of the first button holes to detachably affix the resilient strap 311C at the cushioning sleeve 211C. Preferably, the second tension fastener 352C further has a second button hole formed at the outer cushioning layer 213C, wherein the fastening button is provided at the inner cushioning layer 212C to align with the second button hole. Therefore, when the resilient strap 311C is slid within the sliding cavity 214C to selectively align the second button hole with one of the first button holes, the fastening button is fastened with the first and second button holes to affix the resilient strap 311C at the cushioning sleeve 211C. As the longer length of the resilient strap 311C being exposed out of the cushioning sleeve 21C, the tension of the resilient strap 311C will be increased. In other words, the wearer is able to increase the tension of each of the resilient straps 311C by lengthening the portion of the resilient strap 311C exposed out of the cushioning sleeve 211C and is able to reduce the tension of each of the resilient straps 311C by shortening the portion of the resilient strap 311C exposed out of the cushioning sleeve 211C. It is worth mentioning that the receiving sleeves 33 can be incorporated with this detachably affixing structure that the receiving sleeve 33 is extended to cover the top opening 215C of each of the cushioning sleeve 211C of the shoulder strap 211C.

Figure 7:
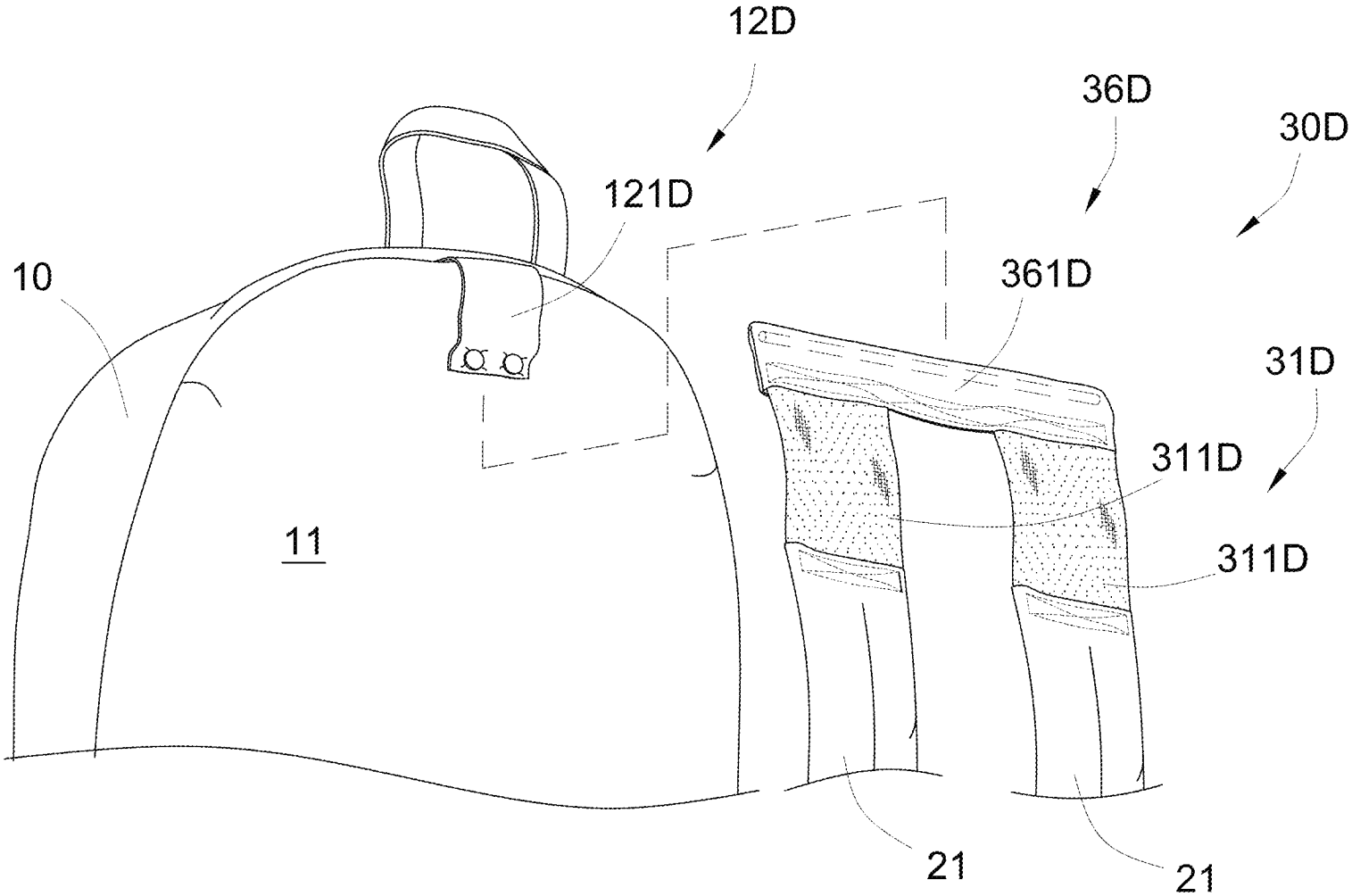
FIG. 7 illustrates a fourth alternative mode of the suspension arrangement of the backpack according to the above preferred embodiment of the present invention.

FIG. 7 illustrates a fourth alternative mode the suspension arrangement 30D to allow the user to adjust the tension of the resilient unit 31D. Accordingly, the suspension arrangement 30D further comprises a back supporting member 36D detachably coupled to the back side 11 of the pack body 10, wherein the resilient unit 31D is provided between the back supporting member 36D and the shoulder straps 21.

As shown in FIG. 7, the back supporting member 36D comprises an elongated attachment member 361D extended between two upper ends of the resilient straps 311D in a transverse direction, such that the resilient straps 311D and the attachment member 361D form an inverted "U" shaped configuration. Accordingly, when the attachment member 361D is detachably coupled at the pack body 10, the upper ends of the resilient straps 311D are coupled at the back side of the pack body 10. Preferably, the attachment member 361D is made of rigid but light weight material.

The pack body 10 further comprises a receiving pocket 12D formed at the back side 11 of the pack body 10 to receive the back supporting member 36D. As shown in FIG. 7, the receiving pocket 12D is formed at the top edge of the pack body 10. In particular, the receiving pocket 12D comprises a pocket leaf 121D having one affixing edge firmly affixed to the pack body 10 and an opposed detachable edge detachably coupling at the back side 11 of the pack body 10 to overlap the pocket leaf 121D thereon so as to form a pocket cavity between the pocket leaf 121D and the back side 11 of the pack body 10. The width of the pocket leaf 121D is slightly smaller than a length of the attachment member 361D, such that the attachment member 361D can be tightly wrapped within the pocket cavity of the pocket leaf 121D. It is appreciated that the detachable edge of the pocket leaf 121D can be detachably coupled at the back side 11 of the pack body 10 via snap buttons, button and button hole attachment, hook and loop fasteners, zippers, or the like. Therefore, the wearer is able to change the resilient unit 31D by detaching the resilient unit 31D from the receiving pocket 12D and by re-attaching the desired resilient unit 31D with proper tension thereof to the receiving pocket 12D.

Figure 8:
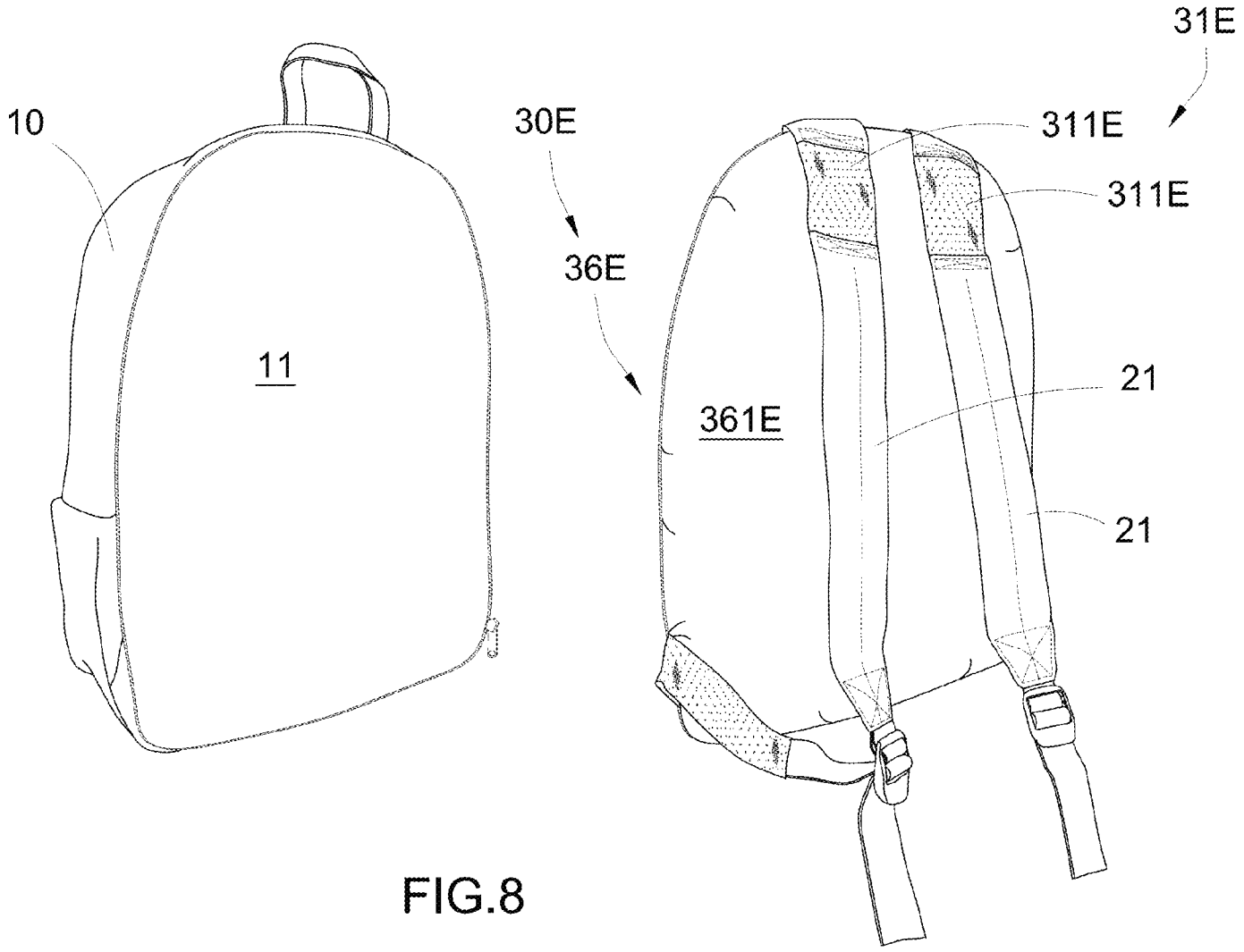
FIG. 8 illustrates a fifth alternative mode of the suspension arrangement of the backpack according to the above preferred embodiment of the present invention.

FIG. 8 illustrates another alternative mode the back supporting member 36E of the suspension arrangement 30E to allow the user to adjust the tension of the resilient unit 31E. The back supporting member 36E comprises a cushioning panel 361E shaped and sized corresponding to the back side 11 of the pack body 10, wherein the resilient straps 311E are extended from the cushioning panel 361E. In addition, the shoulder straps 21 are also extended from the cushioning panel 361E to affix with the resilient straps 311D respectively. As shown in FIG. 8, the cushioning panel 361E is detachably coupled at the back side 11 of the pack body 10. Accordingly, a peripheral edge portion of the cushioning panel 361E is detachably coupled at a peripheral edge portion of the back side 11 of the pack body 10 via a fastening means. Preferably, the fastening means can be a zipper. Alternatively, the fastening means can be snap buttons, button and button hole attachment, hook and loop fasteners, or the like. Therefore, the wearer is able to change the resilient unit 31E by detaching the cushioning panel 361E from the pack body 10 and by re-attaching the cushioning panel 361E with the desired tension of the resilient unit 31E to the back side 11 of the pack body 10.

As shown in FIGS. 9 to 15, a backpack according to a second embodiment illustrates an alternative mode of the first embodiment, wherein the backpack comprises a pack body 10F, a carrying system 20F, and a suspension arrangement 30F.

The pack body 10F, which is made of durable and waterproof material, has an elongated shape that a length of the pack body 10F is larger than a width thereof. The pack body 10F has a storage cavity 101F for receiving one or more items as a load of the pack body 10F, and a top opening 102F, wherein the pack body 10F comprises a back panel 11F, a front panel 12F, two side panels 13F and a bottom panel 17F to define the storage cavity 101F within the back panel 11F, the front panel 12F, the side panels 13F, and the bottom panel 17F. Preferably, the bottom panel 17F is made of EVA (Ethylene Vinyl Acetate) material. Cushioning pads are provided at the back panel 11F. The pack body 10F further comprises an opening cover 14F foldably extended from the rear panel 11F of the pack body 10F to the front panel 12F thereof for covering the top opening 102F and enclosing the storage cavity 101F. Therefore, the opening cover 14F can be upwardly flipped to open up the top opening 102F.

Figure 9:
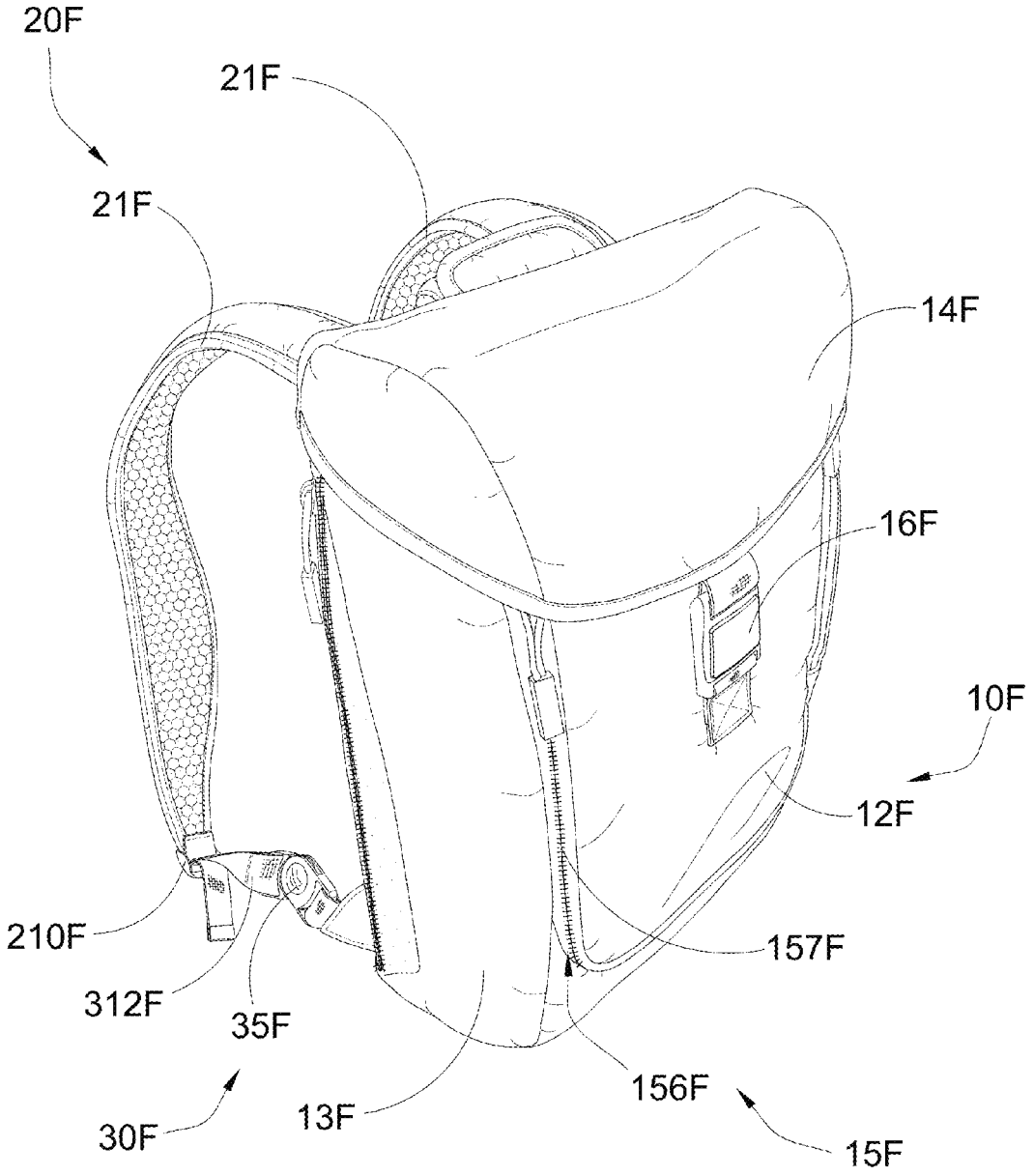
FIG. 9 is a front perspective view of a backpack with a suspension arrangement according to a second preferred embodiment of the present invention.
Figure 18:
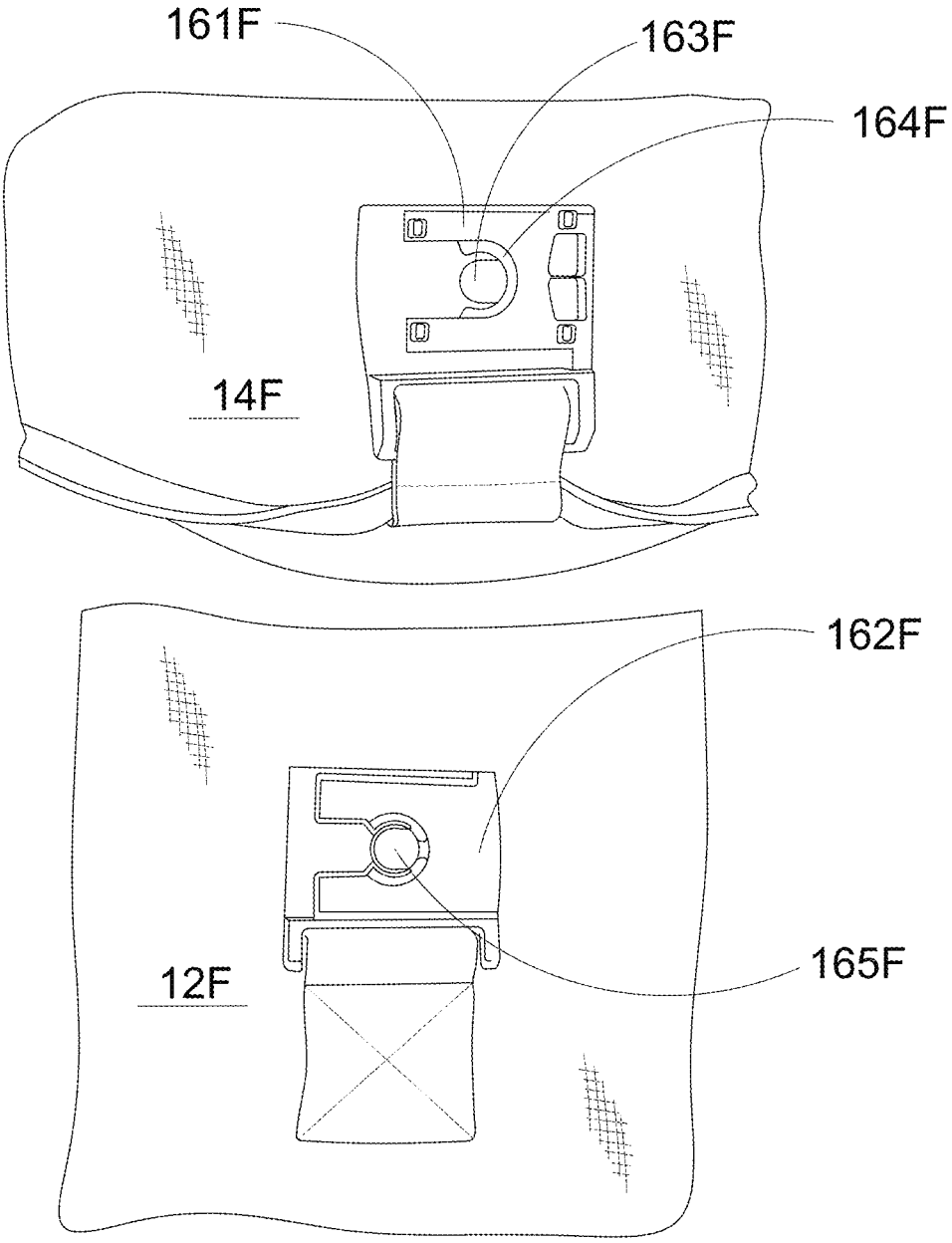
FIG. 18 is a perspective view of a cover locker of the backpack according to the second preferred embodiment of the present invention.
Figure 19:
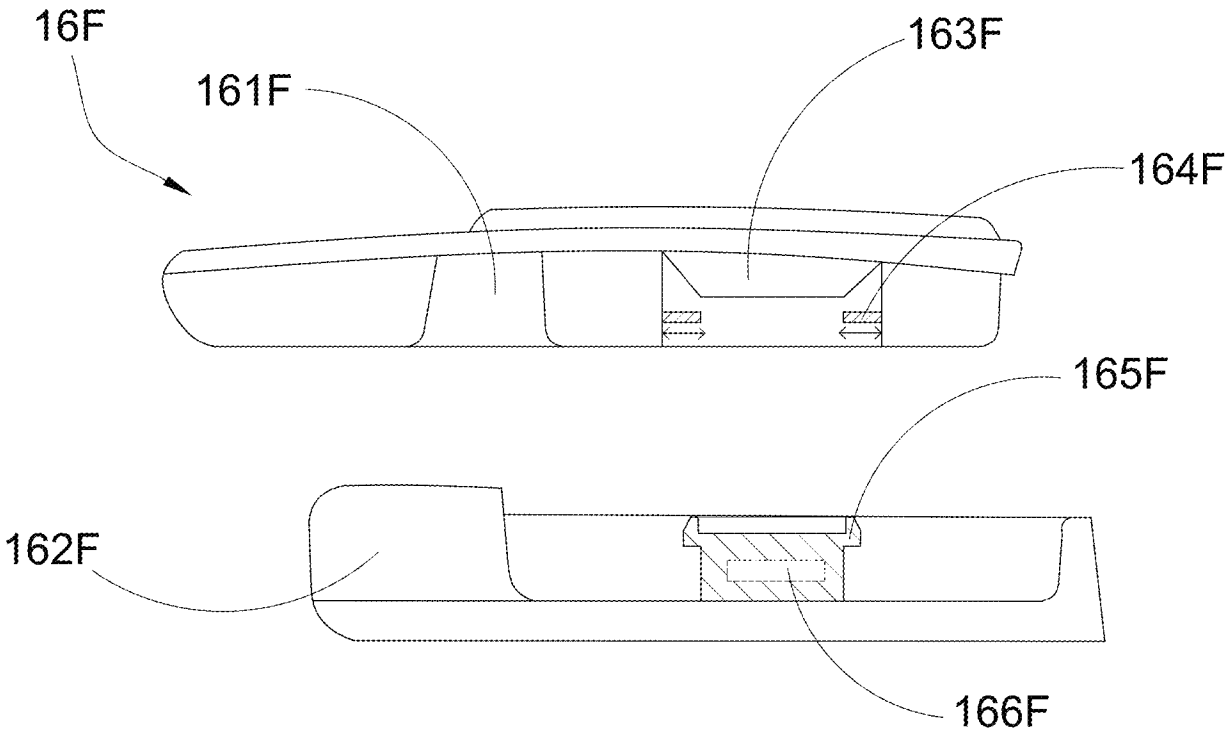
FIG. 19 is a side view of the cover locker of the backpack according to the second preferred embodiment of the present invention.

As shown in FIGS. 9, 18 and 19, the pack body 10F further comprises a cover locker 16F releasably coupled the opening cover 14F at the front panel 12F. Accordingly, the cover locker 16F comprises a first locker member 161F provided at a front edge of the opening cover 14F and a second locker member 162F provided at the front panel 12F to detachably couple with the first locker member 161F. In particular, the second locker member 162F is overlapped and engaged with the first locker member 161F. The first locker member 161F comprises a first magnetic element 163F and a U-shaped resilient locker 164F, wherein the first magnetic element 163F is located within the U-shaped resilient locker 164F. The second locker member 162F comprises a tapered locking head 165F with a second magnetic element 166F embedded therein, wherein the tapered locking head 165F has an enlarged head portion with a slanted circumferential surface, and a narrowed neck portion downwardly extended from the enlarged head portion. When the second magnetic element 166F is magnetically attracted with the first magnetic element 163F, the U-shaped resilient locker 164F is expanded to slide at the tapered locking head 165F until the U-shaped resilient locker 164F is engaged with the neck portion of the tapered locking head 165F. It is worth mentioning that the magnetic attracting force between the first magnetic element 163F and the second magnetic element 166F will force the U-shaped resilient locker 164F to expand and to slide at the tapered locking head 165F. Therefore, the second locker member 162F is overlapped and engaged with the first locker member 161F. Accordingly, in order to unlock the cover locker 16F, the second locker member 162F must be sidewardly slid to disengage with the first locker member 161F. Since the U-shaped resilient locker 164F is engaged with the neck portion of the tapered locking head 165F, the U-shaped resilient locker 164F cannot be directly pulled to disengage with the tapered locking head 165F. Therefore, the tapered locking head 165F must be slid out of an opening of the-shaped resilient locker 164F in order to disengage the U-shaped resilient locker 164F with the tapered locking head 165F. In other words, the direction of unlocking the cover locking 16F is different from the direction of folding the opening cover 14F to open up the top opening 102F. Therefore, the opening cover 14F will not be accidentally opened by unintentionally unlocking the cover locker 16F.

The pack body 10F further comprises an accessing arrangement 15F for accessing the storage cavity 101F. The accessing arrangement 15F comprises a partition wall 151F provided in the storage cavity 101F to partition the storage cavity 101F into a front cavity 103F and a rear cavity 104F. Preferably, four edges of the partition wall 151F are affixed to the back panel 11F, the front panel 12F and the side panels 13F, such that the front cavity 103F and the rear cavity 104F are two discrete cavities that no access can be formed therebetween. It is worth mentioning that the top opening 102F communicate with the front cavity 103F, wherein when the opening cover 14F is upwardly flipped, only the front cavity 103F is opened up. In order to access the rear cavity 104F, the accessing arrangement 15F further comprises a side opening 152F formed on at least one of the side panels 13F to communicate with the rear cavity 104F, and a side fastener 153F provided at the corresponding side panel 13F at the side opening 152F to selectively close the side opening 152F. In one embodiment, the side fastener 153F is a zipper formed at the edges of the side opening 152F to open or close the side opening 152F. Preferably, an upper end of the side opening 152F is extended close to an upper edge of the side panel 13F and the lower end of the side opening 152F is extended close to a lower edge of the side panel 13F. Therefore, when the side fastener 153 is actuated to open up the side opening 152F, the wearer is able to fully access the rear cavity 104F. Accordingly, a portable electronic device, such as laptop or tablet computer, can be stored and protected in the rear cavity 104F since the rear cavity 104F cannot access to the front cavity 103F.

In one embodiment, a volume of the front cavity 103F is larger than a volume of the rear cavity 104F. In order to allow the wearer to easily access the bottom of the front cavity 103F, the accessing arrangement 15F further comprises an enlarging slit 154F extended from the top opening 102F to enlarge an opening area of the front cavity 103F, and an enlarging fastener 155F provided at the enlarging slit 154F. Accordingly, the enlarging slit 154F is formed at a side edge of the front panel 12F, wherein when the enlarging fastener 155F is actuated to open up the enlarging slit 154F, the opening area of the front cavity 103F is enlarged by the top opening 102F and the enlarging slit 154F. Therefore, the wearer is able to access the bottom of the front cavity 103F through the enlarged opening area. It is worth mentioning that the wearer is able to access the upper section of the front cavity 103F through the top opening 102F when the enlarging slit 154F is closed. Preferably, the enlarging fastener 155F is also a zipper.

It is appreciated that the pack body 10F further has a front pocket 105F formed behind the front panel 12F and in front of the front cavity 103F, wherein the top opening 102F serves as a common opening for the front pocket 105F and the front cavity 103F. In other words, the opening cover 14F is folded to close the top opening 102F in order to enclose the front pocket 105F and the front cavity 103F at the same time. Likewise, the accessing arrangement 15F further comprises a front slit 156F extended from the top opening 102F to enlarge an opening area of the front pocket 105F, and a front fastener 157F provided at the front slit 156F. Accordingly, the front slit 156F has a L-shape or U-shape formed at the front panel 12F, wherein when the front fastener 157F is actuated to open the front slit 156F, the front panel 12F can be frontwardly flipped to open up the front pock 105F. The front fastener 157F is also a zipper.

The carrying system 20F comprises two shoulder straps 21F extended from the pack body 10F for allowing the wearer to wear the pack body 10F at the wearer's back. Preferably, the shoulder straps 21F are provided at the back panel 11F of the pack body 10F. A front detachable pocket 18F is provided to detachably couple at one of the shoulder straps 21F.

The suspension arrangement 30F comprises a resilient unit 31F provided between the pack body 10F and the shoulder straps 21F, wherein the resilient unit 31F allows a relative movement of the pack body 10F with respect to each of the shoulder straps 21F. Accordingly, the resilient unit 31F provides a predetermined tension between the pack body 10F and the shoulder straps 21F, such that the pack body 10F can be relatively moved with respect to the shoulder straps 21F.

Figure 10:
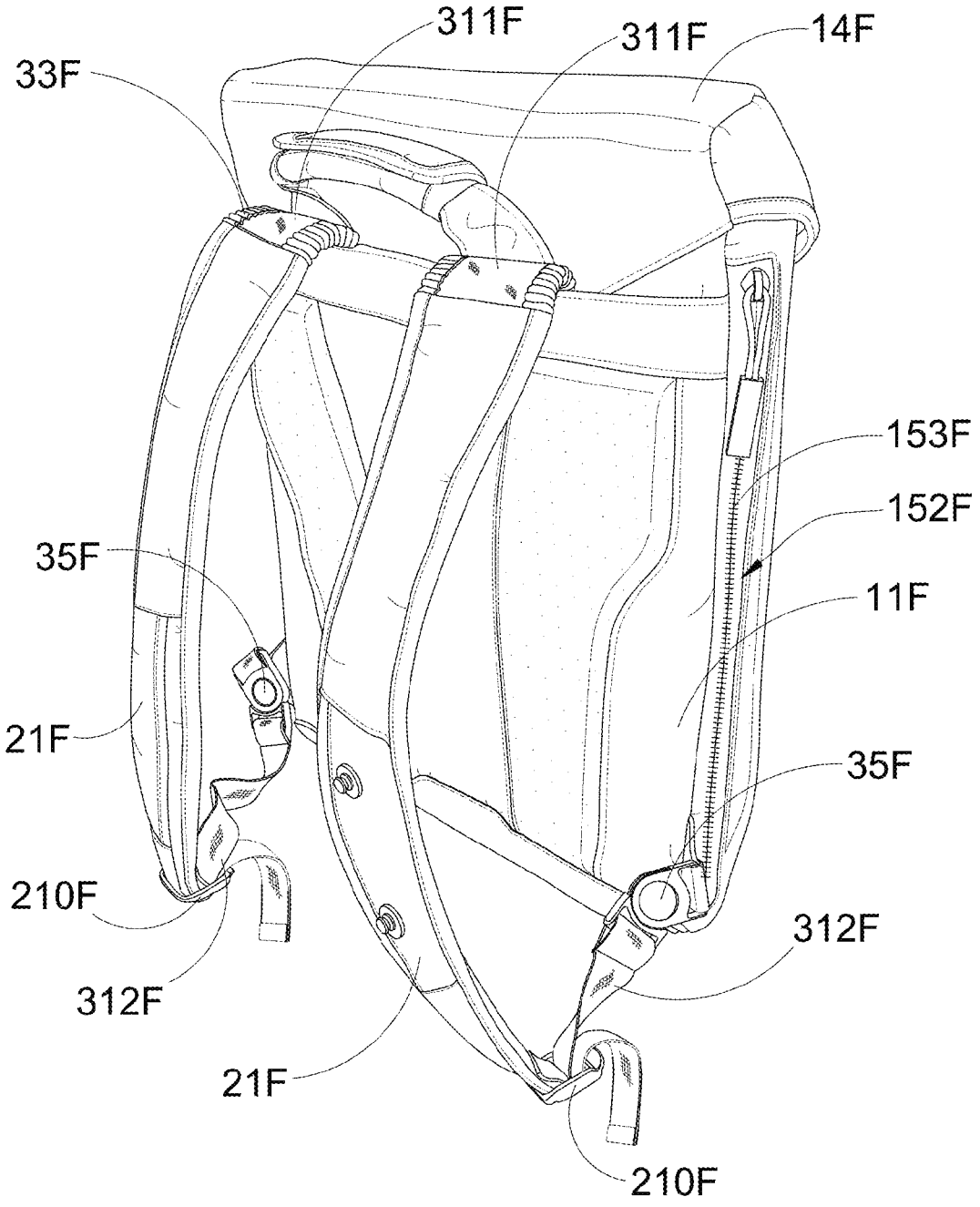
FIG. 10 is a rear perspective view of the backpack with the suspension arrangement according to the second preferred embodiment of the present invention.
Figure 11:
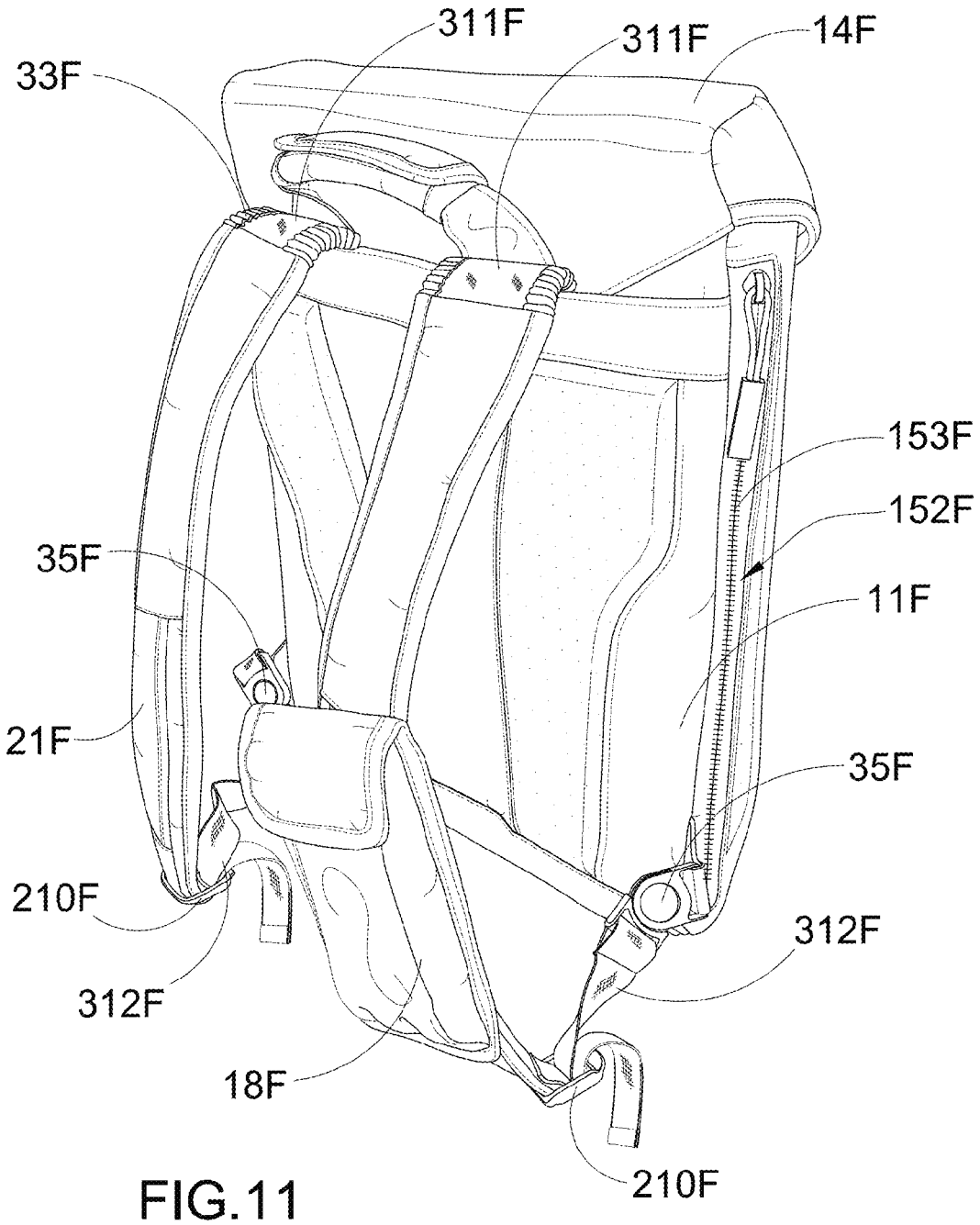
FIG. 11 is a rear perspective view of the backpack with the suspension arrangement according to the second preferred embodiment of the present invention, illustrating a front detachable pocket coupled at the shoulder strap.
Figure 12:
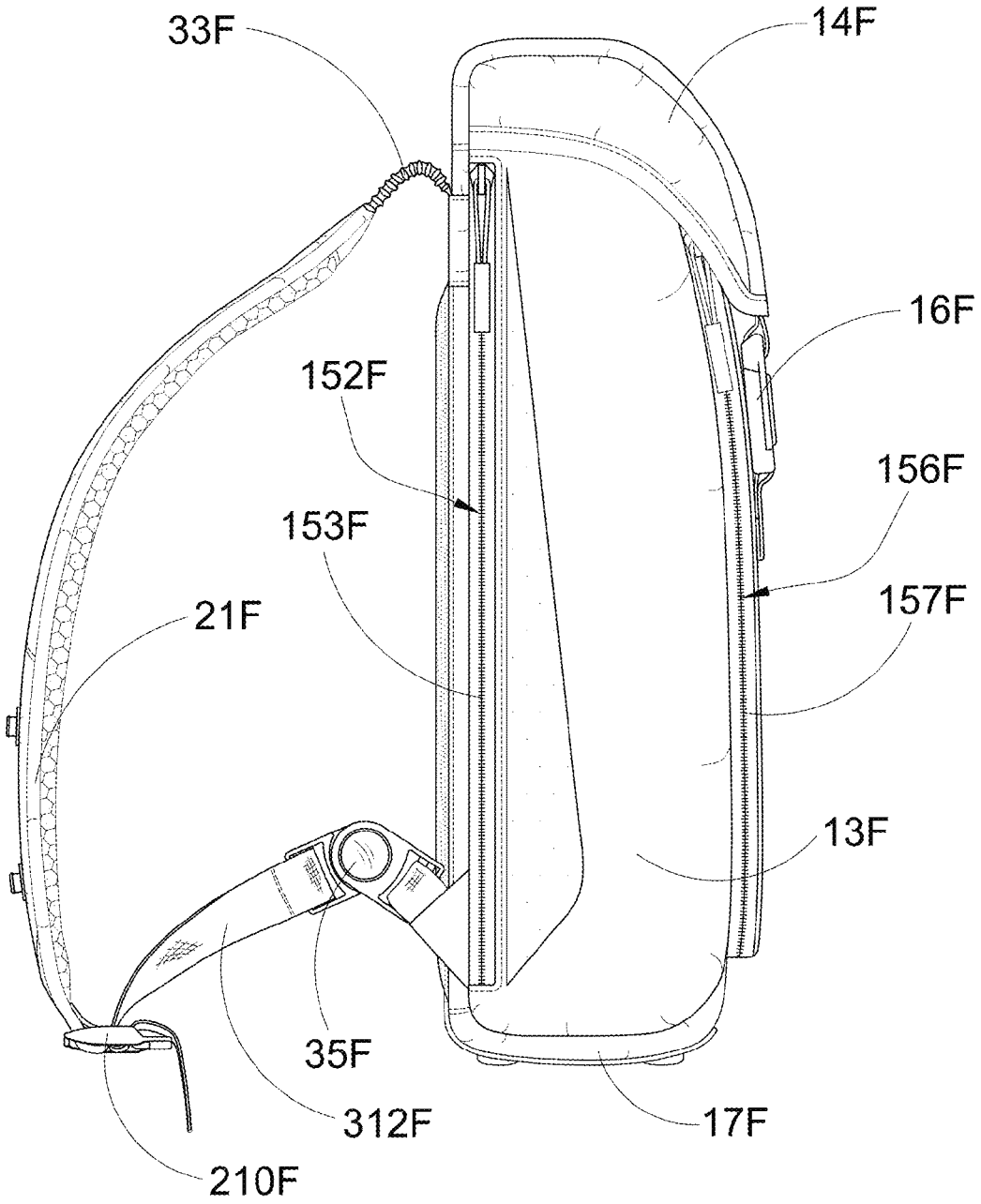
FIG. 12 is a left side view of the backpack with the suspension arrangement according to the second preferred embodiment of the present invention.
Figure 13:
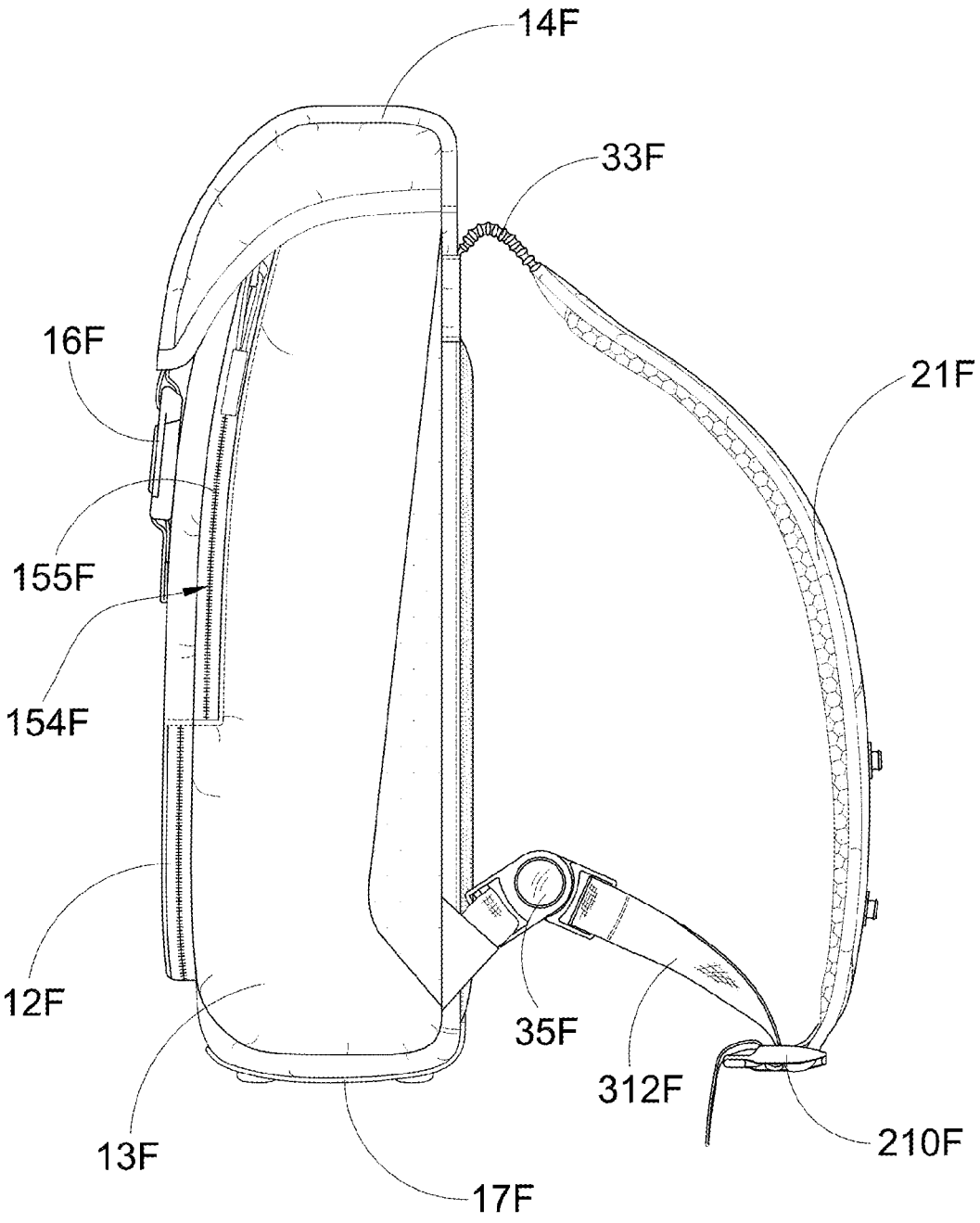
FIG. 13 is a right side perspective view of the backpack with the suspension arrangement according to the second preferred embodiment of the present invention.
Figure 14:
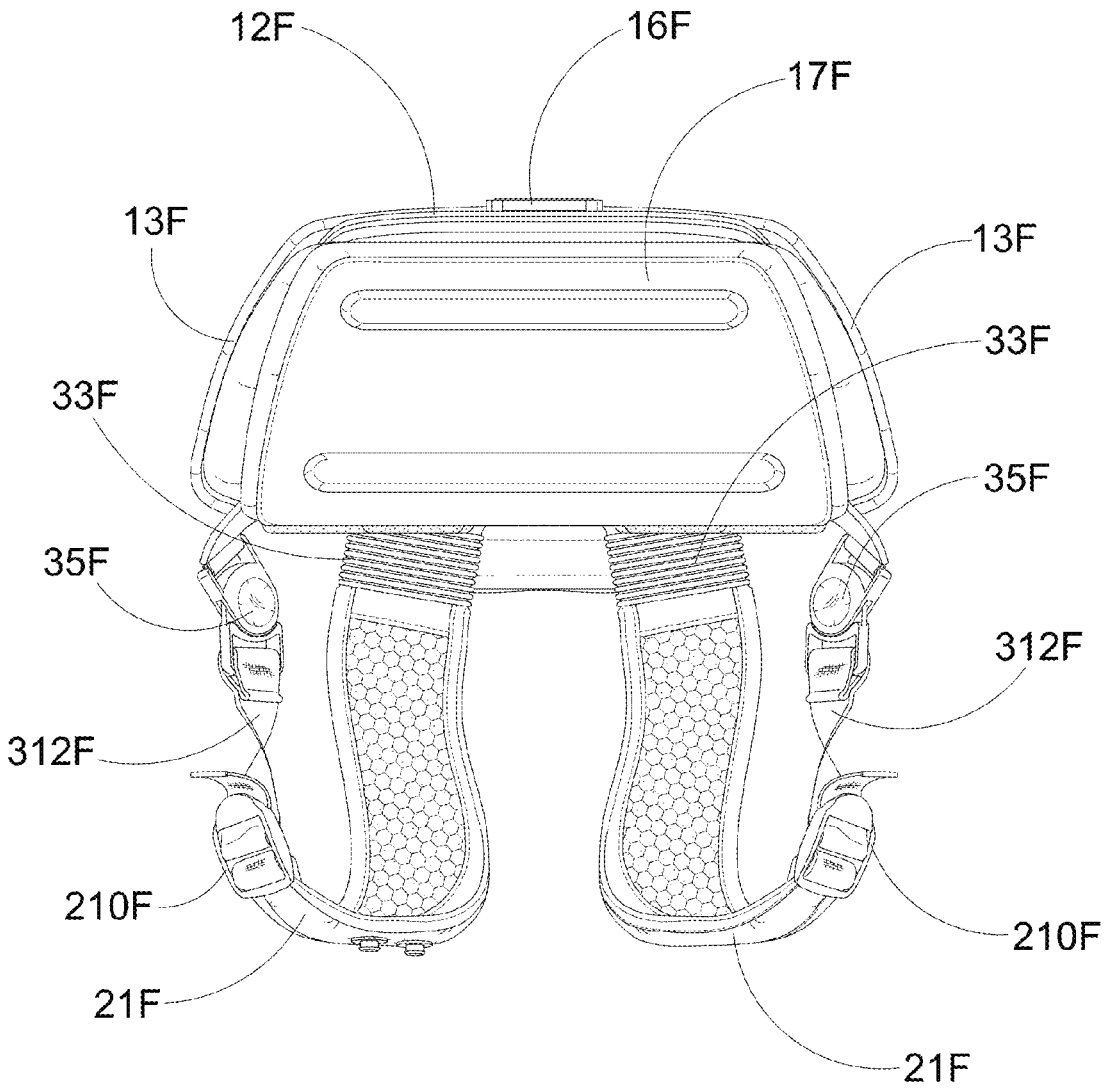
FIG. 14 is a bottom view of the backpack with the suspension arrangement according to the second preferred embodiment of the present invention.
Figure 15:
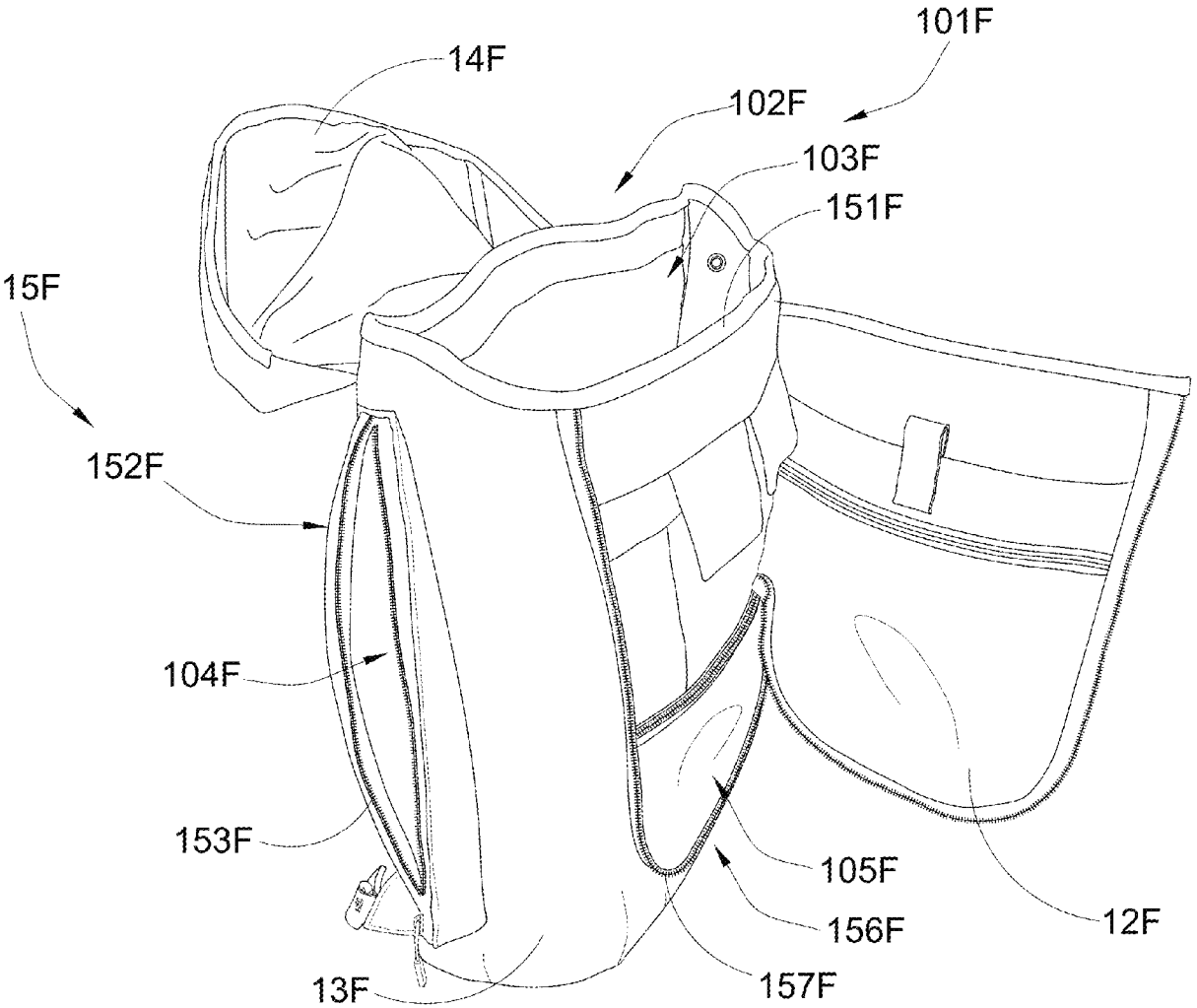
FIG. 15 is a partially perspective view of the backpack with the suspension arrangement according to the second preferred embodiment of the present invention, illustrating the front cavity, the rear cavity, and the front pocket of the pack body.
Figure 16:
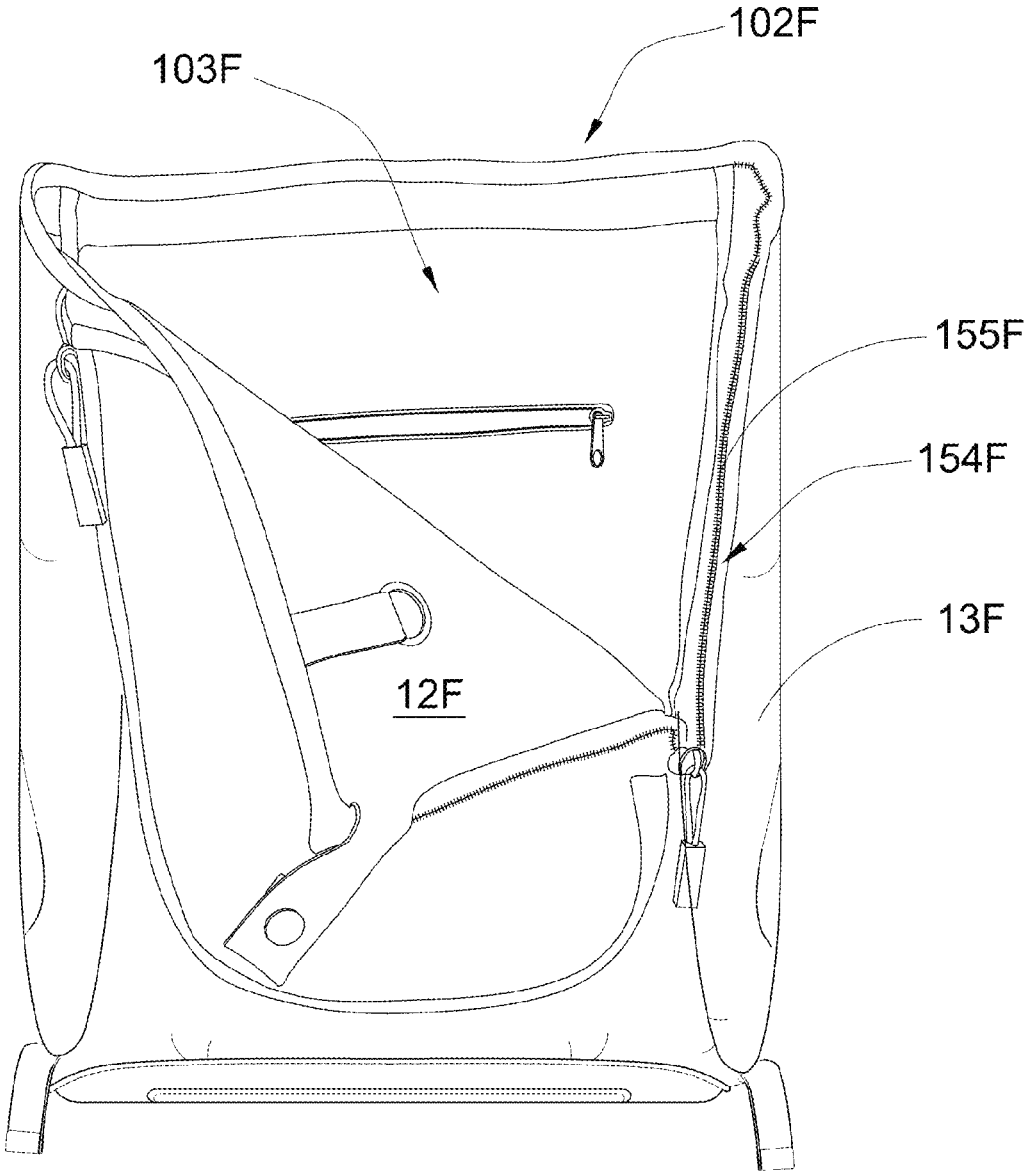
FIG. 16 is a front view of the backpack with the suspension arrangement according to the second preferred embodiment of the present invention, illustrating the enlarging slit.
Figure 17:
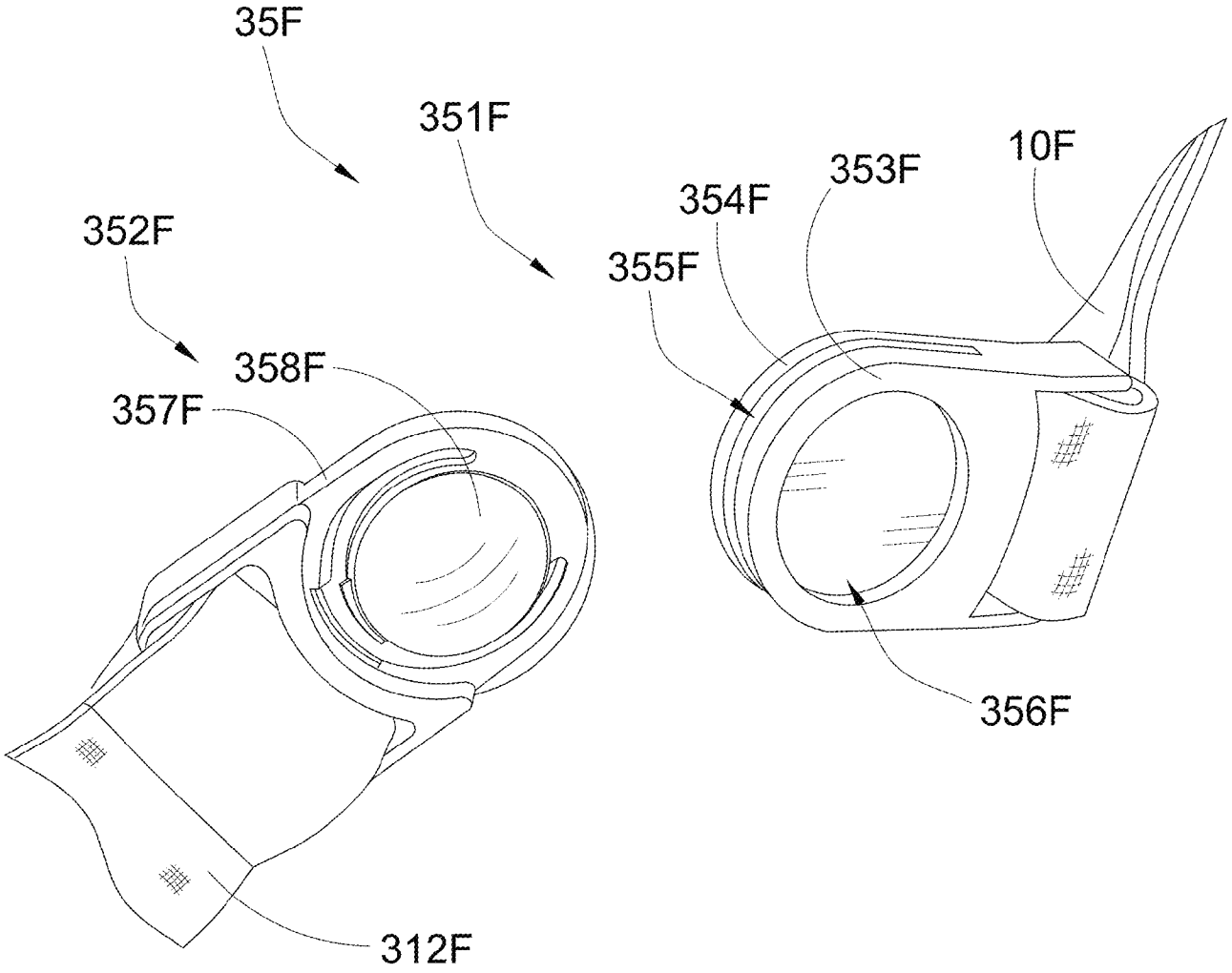
FIG. 17 illustrates the strap fastening unit of the backpack according to the second preferred embodiment of the present invention.

As shown in FIGS. 10 and 11, the resilient unit 31F comprises two resilient straps 311F extended from upper ends of the shoulder straps 21F respectively to the pack body 10F, wherein each of the resilient straps 311F provides the resilient force to absorb the bounding force of the pack body 10F to the respective shoulder strap 21F. In other words, the two resilient straps 311F provide the independent resilient forces at the shoulder straps 21F respectively to individually absorb the bounding force of the pack body 10F.

The suspension arrangement 30F further comprises two receiving sleeves 33F extended from the pack body 10F to the upper ends of the shoulder straps 21F to receive the resilient straps 311F within the receiving sleeves 33F respectively in a hidden manner, as shown in FIGS. 10 and 11. Each of the receiving sleeves 33F has a tubular shape to receive the resilient strap 311F. Accordingly, each of the receiving sleeves 33F, having a bellow shape, has an upper end coupled to the pack body 10F and a lower end coupled to the upper end of the shoulder strap 21F, such that the resilient straps 311F is received along the receiving sleeve 33F in a hidden manner. It is worth mentioning that the bellow shaped receiving sleeve 33F allows the resilient straps 311F to be stretched correspondingly. In other words, a length of each of the receiving sleeves 33F is long enough to cover the maximum length of the resilient strap 311F that the resilient strap 311F is stretched in a maximum condition between the upper edge and the lower edge. Therefore, when the backpack is worn by the wearer, the two resilient straps 311F are hidden and cannot be seen.

The resilient unit 31F further comprises two lower resilient straps 312F extended from lower ends of the shoulder straps 21F respectively to the pack body 10F, wherein the lower resilient straps 312F will also provide the resilient force to absorb the bounding force of the pack body 10F to the respective shoulder strap 21F. The resilient straps 311F, 312F are made of stretchable material to generate the resilient force. Preferably, the resilient straps 311F are permanently affixed between the upper ends of the shoulder straps 21F and the pack body 10F, and the lower resilient straps 312F are detachably affixed between the lower ends of the shoulder straps 21F and the pack body 10F.

Accordingly, the lower resilient strap 312F is detachably and slidably coupled to the lower end of the shoulder strap 21F via a strap slide 210F. The strap slide 210 can allow the lower end of the shoulder strap 21F to be detached from the lower resilient strap 312F so as to detach the lower end of the shoulder strap 21 from the pack body 10F. The strap slide 210F is provided at the lower end of each of the shoulder straps 21F. The strap slide 201F can also allow a usage length of the lower resilient strap 312F, i.e. a distance between the pack body 10F and the lower end of the shoulder strap 21F, to be selectively adjusted. It is worth mentioning that when the usage length of the lower resilient strap 312F is decreased, the lower resilient strap 312F will generate lesser resilient force, and when the usage length of the lower resilient strap 312F is increased, the lower resilient strap 312F will generate larger resilient force.

As shown in FIGS. 10 to 14 and 17, the suspension arrangement 30F further comprises a strap fastening unit 35F for detachably coupling each of the lower resilient straps 312F at the pack body 10F. The strap fastening unit 35F comprises two first strap fasteners 351F extended from the back pack 10F and two second strap fasteners 352F provided at the lower ends of the lower resilient straps 312F respectively, wherein the first strap fasteners 351F are detachably coupled with the second strap fasteners 352F to detachably couple the lower resilient straps 312F at the pack body 10F.

Each of the first strap fasteners 351F comprises first and second fastener panels 353F, 354F defining a sliding gap 355F therebetween and an engaging through slot 356F formed at the first fastener panel 353F to communicate with the sliding gap 355F. Each of the second strap fasteners 352F comprises a sliding panel 357F slidably inserted into the sliding gap 355F and a resilient engaging member 358F flexibly protruded from the sliding panel 357F to engage with the engaging through slot 356F when the sliding panel 357F is slid into the sliding gap 355F to detachably couple the second strap fastener 352F with the first strap fastener 351F. In order to detach the second strap fastener 352F from the first strap fastener 351F, the resilient engaging member 358F is pressed on the sliding panel 357F to disengage with the engaging through slot 356F, such that the sliding panel 357F is slid out of the sliding gap 355F. It is worth mentioning that the engaging through slot 356F is a circular through hole and the resilient engaging member 358F has a circular shape. Therefore, when the resilient engaging member 358F is engaged with the engaging through slot 356F, the sliding panel 357F can be rotated at the sliding gap 355F to rotatably couple the second strap fastener 352F with the first strap fastener 351F. In other words, the strap fastening unit 35F not only provides a detachable feature for detachably coupling each of the lower resilient straps 312F at the pack body 10F but also serves as a rotatable point for rotatably coupling each of the lower resilient straps 312F at the pack body 10F.

As a result, the lower resilient straps 312F is detachably affixed to the pack body 10F, such that the user is able to change different lower resilient straps 312F with different tensions corresponding to the load of the backpack.

Figure 20:
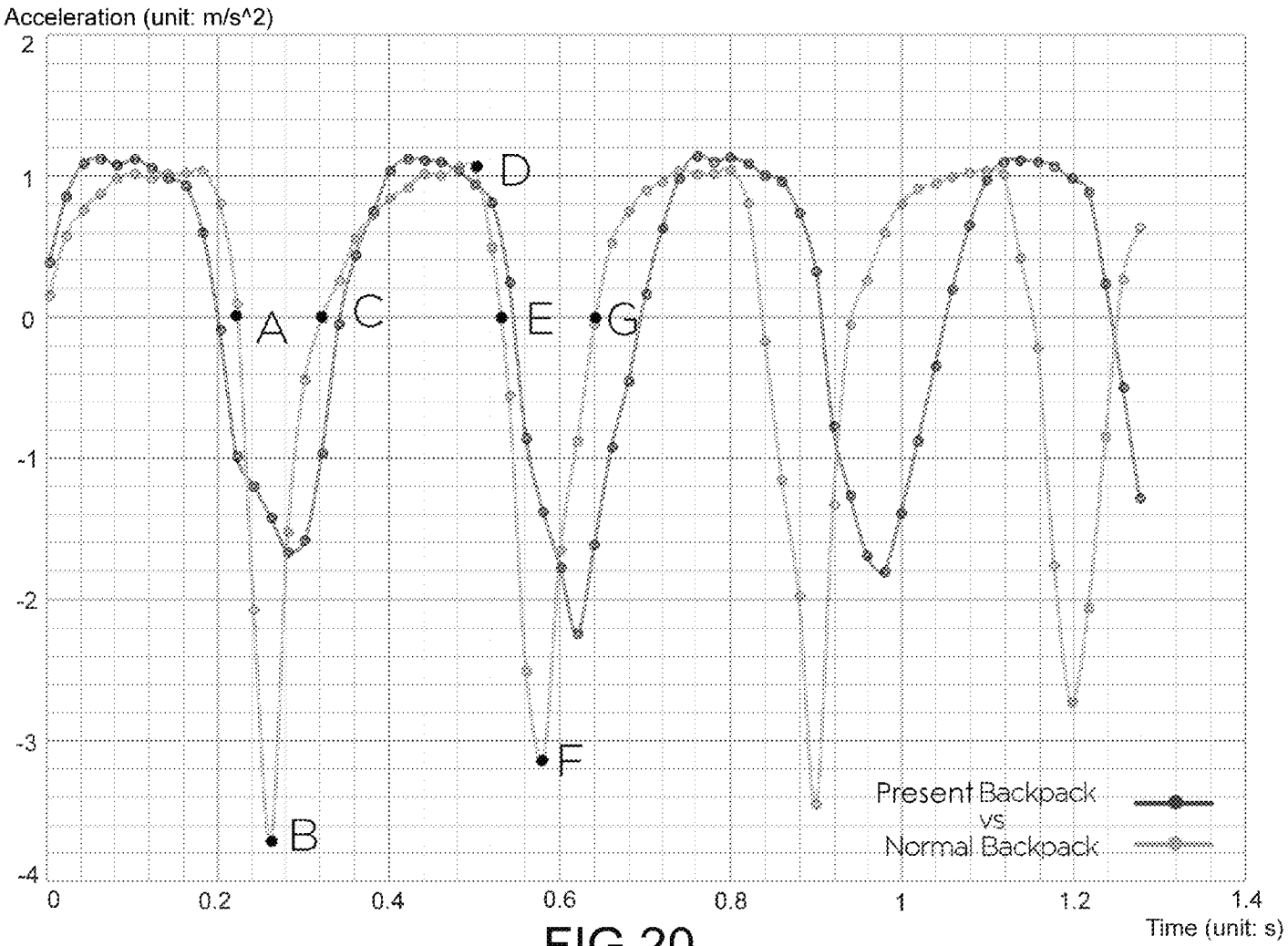
FIG. 20 is a graph illustrating the loading force applied at the shoulders of the wearer by the present invention and the normal backpack.
Figure 22:
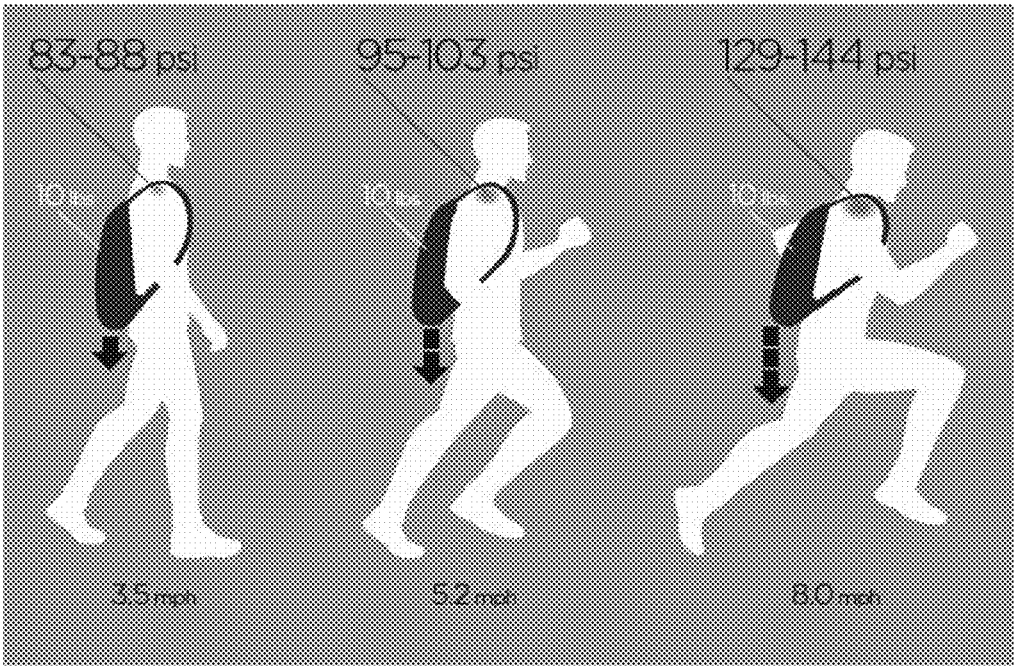
FIG. 22 (Prior Art)
FIG. 22 illustrates the pressure on the shoulders of the wearer when wearing the conventional backpack.
Figure 23:
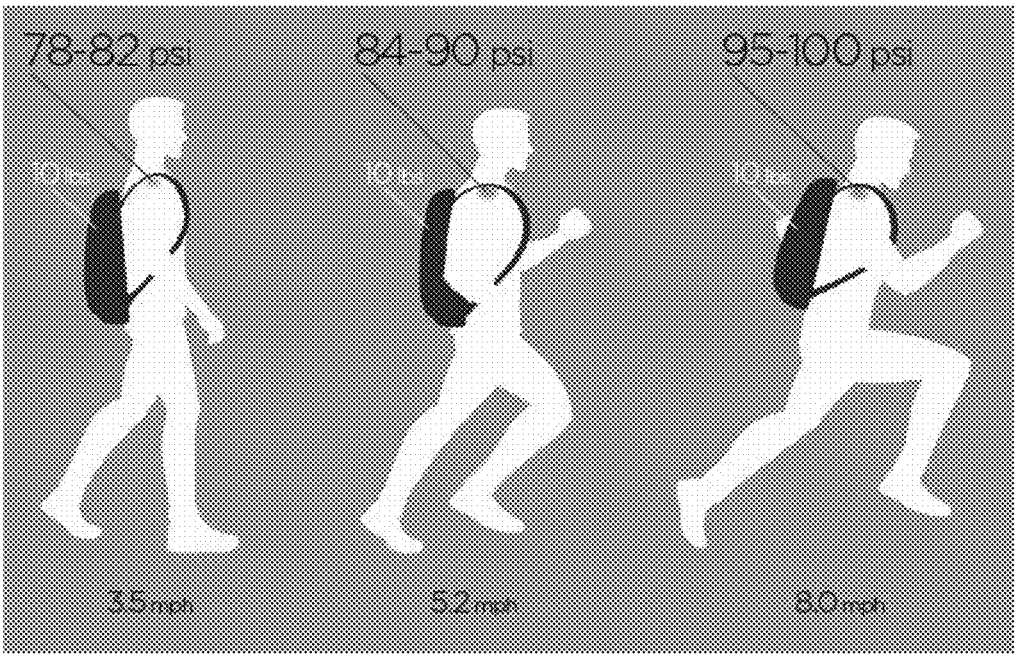
FIG. 23 illustrates the pressure on the shoulders of the wearer when wearing the backpack of the present invention.

FIGS. 20, 22, and 23 illustrates the loading force applied at the shoulders of the wearer by the present invention and the normal backpack (conventional backpack). Assuming that the acceleration of the wear is about 5.2 mph (mile per hour), the wearer wears the present backpack and the normal backpack respectively loaded with the same weight (10 lb). When the wearer is stationary, i.e. not moving, the loading force applied at the shoulders of the wearer through the shoulder straps of the present invention is the same as the loading force applied at the shoulders of the wearer through the shoulder straps of the normal backpack.

When the wearer walks or runs, the backpack will moved up and down according to the step movement of the wearer. Assumed that the value of upward acceleration of the backpack is positive and the value of the downward acceleration of the backpack is negative. When the wearer's body moves up during walks or runs, the value of acceleration of the normal backpack is negative from point A to point B to point C, wherein the point B is a bottom peak and has the maximum valve of the upward acceleration of the normal backpack. In other words, the maximum loading force applied at the shoulders of the wearer through the shoulder straps of the normal backpack is defined at the point B according to the upward movement of the wearer. When the wearer's body moves down during walks or runs, the value of acceleration of the normal backpack is positive from point C to point D to point E, wherein the point D is a top peak and has the maximum valve of the downward acceleration of the normal backpack. In other words, the maximum loading force applied at the shoulders of the wearer through the shoulder straps of the normal backpack is defined at the point D according to the downward movement of the wearer. Then, the wearer's body will move up again during walks or runs, wherein the value of acceleration of the normal backpack is negative from point E to point F to point G. Therefore, the point F is another bottom peak and has the maximum valve of the upward acceleration of the normal backpack.

Comparing the top peaks and the bottom peaks of the loading forces at the present backpack and the normal backpack, the top peaks of the loading forces for the present backpack are lower than the top peaks of the loading forces for the normal backpack, and the bottom peaks of the loading forces for the present backpack are higher than the bottom peaks of the loading forces for the normal backpack. It means that the loading forces applied to the shoulders of the wearer via the present backpack are smaller than the loading forces applied to the shoulders of the wearer via the normal backpack. In addition, the amplitudes of the loading forces of the present backpack is smaller than the amplitudes of the loading forces of the normal backpack, such that the present backpack can be stably worn by the wearer comparing with the normal backpack by minimizing the up-and-down movement of the backpack.

Furthermore, FIG. 20 also illustrates the loading time for the downward loading force applied on the shoulders of the wearer, wherein the pressure on the shoulders of the wearer will be increased via the downward loading force when the loading time is prolonged, and the pressure on the shoulders of the wearer will be reduced via the downward loading force when the loading time is shortened.

An acceleration sensor is utilized for determining the acceleration of the backpack for a time interval of 1/50 second. The loading time for the loading force applied on the shoulders of the wearer via the normal backpack is 0.08 second. The loading time for the loading force applied on the shoulders of the wearer via the present backpack is 0.12 second. Therefore, the present invention provides a better buffering than the normal backpack.

FIG. 21 is a table illustrating the maximum pressure applied to the shoulders of the wearer with respect to the acceleration thereof. For example, a miniature force sensor is placed in each of the present backpack and the normal backpack for determining the maximum pressures thereat, wherein the present backpack and the normal backpack are respectively loaded with the same weight (10 lb), as shown in FIGS. 22 and 23. Comparing the acceleration values from 3 mph to 8 mph, the maximum pressures applied to the shoulders of the wearer by the present backpack are smaller than the maximum pressures applied to the shoulders of the wearer by the normal backpack. Therefore, from FIGS. 20 to 23, the loading force applied at the shoulders of the wearer through the shoulder straps of the present invention is smaller than the loading force applied at the shoulders of the wearer through the shoulder straps of the normal backpack, so as to minimize a continuous bounding movement/force of the backpack to the wearer's body when the wearers walks or runs.

Accordingly, all the features in the above preferred embodiment and its alternatives are interchangeable to achieve the objective of the present invention. In particular, the two resilient straps are made of elastic fabric to provide a predetermined tension to absorb the bounding force of the load at the backpack. The tension of each resilient strap will be self-adjusted corresponding to the load at the backpack to ensure the loading force to be evenly distributed at the shoulder straps. Therefore, the present invention provides a simple but effective configuration for minimizing any continuous bounding movement/force of the backpack to the wearer's body when the wearers walks or runs so as to prevent the cause of the back fatigue and strain for the wearer.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A backpack, comprising:

a pack body;

a carrying system which comprises two shoulder straps extended from said pack body; and a suspension arrangement which comprises two receiving sleeves and a resilient unit provided between said pack body and said shoulder straps for absorbing a bounding force of said pack body to minimize a relative movement of said pack body with respect to each of said shoulder straps, wherein said resilient unit comprises two upper resilient straps extended from upper ends of said shoulder straps respectively to said pack body and two lower resilient straps extended from lower ends of said shoulder straps respectively to said pack body, such that each of said upper and lower resilient straps provides a resilient force to absorb said bounding force of said pack body to said respective shoulder strap, wherein said receiving sleeves are extended from said pack body to said upper ends of said shoulder straps to receive said upper resilient straps within said receiving sleeves respectively in a hidden manner.

2. The backpack, as recited in claim 1, wherein each of said receiving sleeves, which is formed in a bellow shape, has an upper end coupled to said pack body and a lower end coupled to said upper end of said shoulder strap.

3. The backpack, as recited in claim 1, wherein said lower resilient straps are detachably coupled between said lower ends of said shoulder straps and said pack body.

4. The backpack, as recited in claim 2, wherein said lower resilient straps are detachably coupled between said lower ends of said shoulder straps and said pack body.

5. The backpack, as recited in claim 3, wherein said carrying system further comprises two strap slides provided at said lower ends of said shoulder straps to couple with said lower resilient straps respectively, such that each of said strap slides allows said lower end of said shoulder strap to be detached from said lower resilient strap and allows a usage length of said lower resilient strap to be selectively adjusted.

6. The backpack, as recited in claim 4, wherein said carrying system further comprises two strap slides provided at said lower ends of said shoulder straps to couple with said lower resilient straps respectively, such that each of said strap slides allows said lower end of said shoulder strap to be detached from said lower resilient strap and allows a usage length of said lower resilient strap to be selectively adjusted.

7. The backpack, as recited in claim 5, wherein said suspension arrangement further comprises a strap fastening unit for detachably coupling each of said lower resilient straps at said pack body, wherein said strap fastening unit comprises two first strap fasteners extended from said back pack and two second strap fasteners provided at lower ends of said lower resilient straps respectively, wherein said first strap fasteners are detachably and rotatably coupled with said second strap fasteners to detachably couple said lower resilient straps at said pack body.

8. The backpack, as recited in claim 6, wherein said suspension arrangement further comprises a strap fastening unit for detachably coupling each of said lower resilient straps at said pack body, wherein said strap fastening unit comprises two first strap fasteners extended from said back pack and two second strap fasteners provided at lower ends of said lower resilient straps respectively, wherein said first strap fasteners are detachably and rotatably coupled with said second strap fasteners to detachably couple said lower resilient straps at said pack body.

9. The backpack, as recited in claim 7, wherein each of said first strap fasteners comprises first and second fastener panels defining a sliding gap therebetween and an engaging through slot formed at said first fastener panel to communicate with said sliding gap, wherein each of said second strap fasteners comprises a sliding panel slidably inserted into said sliding gap and a resilient engaging member flexibly protruded from said sliding panel to engage with said engaging through slot when said sliding panel is slid into said sliding gap to detachably couple said second strap fastener with said first strap fastener, such that said first strap fastener is detachably and rotatably coupled with said second strap fastener.

10. The backpack, as recited in claim 8, wherein each of said first strap fasteners comprises first and second fastener panels defining a sliding gap therebetween and an engaging through slot formed at said first fastener panel to communicate with said sliding gap, wherein each of said second strap fasteners comprises a sliding panel slidably inserted into said sliding gap and a resilient engaging member flexibly protruded from said sliding panel to engage with said engaging through slot when said sliding panel is slid into said sliding gap to detachably couple said second strap fastener with said first strap fastener, such that said first strap fastener is detachably and rotatably coupled with said second strap fastener.

11. The backpack, as recited in claim 1, wherein said pack body has a storage cavity, a top opening, an enlarging slit extended from said top opening to enlarge an opening area of said storage cavity, and an enlarging fastener provided at said enlarging slit.

12. The backpack, as recited in claim 4, wherein said pack body has a storage cavity, a top opening, an enlarging slit extended from said top opening to enlarge an opening area of said storage cavity, and an enlarging fastener provided at said enlarging slit.

13. The backpack, as recited in claim 11, wherein said pack body further comprises a partition wall provided in said storage cavity to partition said storage cavity into a front cavity and a rear cavity as two discrete cavities that said top opening only communicates with said front cavity, wherein said an enlarging slit extended from said top opening to enlarge an opening area of said front cavity.

14. The backpack, as recited in claim 12, wherein said pack body further comprises a partition wall provided in said storage cavity to partition said storage cavity into a front cavity and a rear cavity as two discrete cavities that said top opening only communicates with said front cavity, wherein said an enlarging slit extended from said top opening to enlarge an opening area of said front cavity.

15. The backpack, as recited in claim 13, wherein said pack body comprises a back panel, a front panel, two side panels, a bottom panel, an opening cover foldably extended from said rear panel to said front panel for covering said top opening, and a cover locker releasably coupled said opening cover at said front panel, wherein said cover to locker comprises a first locker member provided at a front edge of said opening cover and a second locker member provided at said front panel, wherein said second locker member is sidewardly and slidably engaged with said first locker member.

16. The backpack, as recited in claim 14, wherein said pack body comprises a back panel, a front panel, two side panels, a bottom panel, an opening cover foldably extended from said rear panel to said front panel for covering said top opening, and a cover locker releasably coupled said opening cover at said front panel, wherein said cover locker comprises a first locker member provided at a front edge of said opening cover and a second locker member provided at said front panel, wherein said second locker member is sidewardly and slidably engaged with said first locker member.

17. The backpack, as recited in claim 15, wherein said pack body further has a side opening formed on at least one of said side panels to communicate with said rear cavity, and a side fastener provided at the corresponding side panel at said side opening to selectively close said side opening.

18. The backpack, as recited in claim 16, wherein said pack body further has a side opening formed on at least one of said side panels to communicate with said rear cavity, and a side fastener provided at the corresponding side panel at said side opening to selectively close said side opening.

19. The backpack, as recited in claim 15, wherein said first locker member comprises a U-shaped resilient locker and a first magnetic element located within said U-shaped resilient locker, wherein said second locker member comprises a tapered locking head and a second magnetic element embedded therein, wherein said tapered locking head has an enlarged head portion with a slanted circumferential surface, and a narrowed neck portion downwardly extended from said enlarged head portion, such that when said second magnetic element is magnetically attracted with said first magnetic element, said U-shaped resilient locker is expanded to slide at said tapered locking head until said U-shaped resilient locker is engaged with said neck portion of said tapered locking head.

20. The backpack, as recited in claim 16, wherein said first locker member comprises a U-shaped resilient locker and a first magnetic element located within said U-shaped resilient locker, wherein said second locker member comprises a tapered locking head and a second magnetic element embedded therein, wherein said tapered locking head has an enlarged head portion with a slanted circumferential surface, and a narrowed neck portion downwardly extended from said enlarged head portion, such that when said second magnetic element is magnetically attracted with said first magnetic element, said U-shaped resilient locker is expanded to slide at said tapered locking head until said U-shaped resilient locker is engaged with said neck portion of said tapered locking head.

* * * * *